US012044225B2

(12) United States Patent
Noh et al.

(10) Patent No.: US 12,044,225 B2
(45) Date of Patent: Jul. 23, 2024

(54) LINEAR COMPRESSOR

(71) Applicant: LG ELECTRONICS INC., Seoul (KR)

(72) Inventors: Kiwon Noh, Seoul (KR); Kichul Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/559,448

(22) Filed: Dec. 22, 2021

(65) Prior Publication Data

US 2022/0220953 A1 Jul. 14, 2022

(30) Foreign Application Priority Data

Jan. 11, 2021 (KR) ..... 10-2021-0003339

(51) Int. Cl.
*F04B 39/00* (2006.01)
*F04B 35/04* (2006.01)

(52) U.S. Cl.
CPC ..... *F04B 39/0061* (2013.01); *F04B 35/045* (2013.01); *F04B 39/0005* (2013.01); *F04B 39/0027* (2013.01); *F04B 39/0083* (2013.01)

(58) Field of Classification Search
CPC ..... F04B 35/045; F04B 39/0005; F04B 39/0027; F04B 39/0061; F04B 39/121; F04B 37/18; F04B 39/0055; F04B 39/123
See application file for complete search history.

(56) References Cited

U.S. PATENT DOCUMENTS

2011/0014065 A1 1/2011 Park et al.
2016/0017883 A1* 1/2016 Noh ..... F04B 39/1033 417/437
2017/0321692 A1* 11/2017 Bae ..... F04B 35/045
2018/0135612 A1* 5/2018 Bae ..... F04B 39/0005
2018/0187666 A1* 7/2018 Ahn ..... F04B 39/121
(Continued)

FOREIGN PATENT DOCUMENTS

CN 102121472 7/2011
CN 107339211 11/2017
(Continued)

OTHER PUBLICATIONS

Extended European Search Report in European Appln. No. 22150719.7, dated Oct. 5, 2022, 6 pages.
(Continued)

*Primary Examiner* — Dominick L Plakkoottam
(74) *Attorney, Agent, or Firm* — Fish & Richardson P.C.

(57) ABSTRACT

A linear compressor includes a shell including an intake pipe configured to suction a refrigerant, a cylinder provided inside the shell, a piston configured to reciprocate inside the cylinder, the piston including a piston body and a piston flange, and an intake muffler coupled to the piston and configured to flow a refrigerant suctioned through the intake pipe into the piston body and reduce a flow noise of the suctioned refrigerant. The intake muffler includes a first muffler disposed in the piston body, a second muffler disposed below the first muffler and configured to communicate with the first muffler, and a third muffler configured to accommodate a portion of a rear end of the first muffler and the second muffler.

20 Claims, 16 Drawing Sheets

(56) References Cited

U.S. PATENT DOCUMENTS

| | | | | |
|---|---|---|---|---|
| 2018/0195502 | A1* | 7/2018 | Ahn | F04B 53/008 |
| 2018/0372082 | A1* | 12/2018 | Kim | F04B 35/04 |

FOREIGN PATENT DOCUMENTS

| | | | | |
|---|---|---|---|---|
| CN | 212106186 | | 12/2020 | |
| CN | 212106186 U | * | 12/2020 | F04B 35/04 |
| EP | 3242027 | | 11/2017 | |
| KR | 20180039960 | | 4/2018 | |
| KR | 20180079026 | | 7/2018 | |
| KR | 20180093526 | | 8/2018 | |

OTHER PUBLICATIONS

Notice of Allowance in Korean Appln. No. 10-2021-0003339, dated Jul. 19, 2022, 5 pages (with English translation).
Office Action in Chinese Appln. No. 202111409862.6, mailed on Apr. 28, 2023, 12 pages (with English translation).

* cited by examiner

LINEAR COMPRESSOR

CROSS-REFERENCE TO RELATED APPLICATION

This application claims priority to and the benefit of Korean Patent Application No. 10-2021-0003339 filed in the Korean Intellectual Property Office on Jan. 11, 2021.

TECHNICAL FIELD

The present disclosure relates to a compressor. More specifically, the present disclosure relates to a linear compressor for compressing a refrigerant by a linear reciprocating motion of a piston.

BACKGROUND

A compressor refers to a device that is configured to receive power from a power generator such as a motor or a turbine and compress a working fluid such as air or refrigerant, and is widely used in the whole industry and home appliances.

The compressors may be classified into a reciprocating compressor, a rotary compressor, and a scroll compressor according to a method of compressing the refrigerant.

The reciprocating compressor uses a method in which a compression chamber is formed between a piston and a cylinder to suction or discharge a working gas, and the piston linearly reciprocates in the cylinder to compress a refrigerant.

The rotary compressor uses a method in which a compression chamber is formed between a roller that eccentrically rotates and a cylinder to suction or discharge a working gas, and the roller eccentrically rotates along an inner wall of the cylinder to compress a refrigerant.

The scroll compressor uses a method in which a compression chamber is formed between an orbiting scroll and a fixed scroll to suction or discharge a working gas, and the orbiting scroll rotates along the fixed scroll to compress a refrigerant.

Recently, among the reciprocating compressors, the use of linear compressors is gradually increasing since these linear compressors can improve compression efficiency without a mechanical loss due to motion switch by directly connecting a piston to a drive motor linearly reciprocating and have a simple structure.

The linear compressor is configured such that a piston in a casing forming a sealed space suctions and compresses a refrigerant and then discharges the refrigerant while linearly reciprocating along an axial direction (or axially) in a cylinder by a linear motor.

Here, "axial direction" refers to a direction in which the piston reciprocates.

Thus, a noise occurs in a process in which the piston continues to suction, compress, and discharge the refrigerant while reciprocating in the cylinder along the axial direction.

In order to reduce the noise generated thus, a linear compressor provided with an intake muffler is disclosed in Korean Patent Application Publication No. 10-2018-0079026 (hereinafter, referred to as "prior art").

With reference to FIGS. 1 to 5, an intake muffler included in a linear compressor according to the prior patent is described below.

FIG. 1 is a perspective view illustrating configuration of an intake muffler included in a linear compressor according to the prior patent. FIG. 2 is a cross-sectional view taken along II-IF of FIG. 1.

An intake muffler 2000 disclosed in the prior patent includes a first muffler 2100 disposed inside a piston body 1300, a second muffler 2300 disposed behind the first muffler 2100, and a third muffler 2500 accommodating at least a portion of the first muffler 2100 and the second muffler 2300.

The first muffler 2100 includes a body 2110 that forms a refrigerant flow passage and extends along the axial direction, a flange 2120 extending from the body 2110 along a radial direction (or radially), and a flange extension 2130 extending rearward in the axial direction from a flange connection portion of the flange 2120.

The first muffler 2100 is coupled to the third muffler 2500 by press-fitting the flange extension 2130 to the inside of the third muffler 2500.

The second muffler 2300 is coupled to the third muffler 2500 by press-fitting the second muffler 2300 to the inside of the third muffler 2500 at the rear of the first muffler 2100.

In the intake muffler 2000 having the above-described configuration, the body 2110 of the first muffler 2100 is formed to have a smaller outer diameter than an inner diameter of the piston body 1300, and the flange 2120 of the first muffler 2100 is coupled to a flange 1320 of the piston.

Thus, a discharge space 2100*e* is formed between the piston body 1300 and the body 2110 of the first muffler 2100.

The flange 2120 of the first muffler 2100 includes a plurality of communication holes 2150 communicating with the discharge space 2100*e*.

When an intake of a refrigerant into a compression chamber P is performed, the communication holes 2150 may guide a refrigerant pressure of an intake space 2600 to rapidly increase.

More specifically, when the refrigerant compressed in the compression chamber P is discharged to a discharge cover, a piston 1300 moves from top dead center to bottom dead center, and the refrigerant suctioned by the compressor in this process flows into the piston 1300 through the intake muffler 2000.

In this instance, as the refrigerant pressure in the intake space 2600 is high and this state continues for a long time, an intake valve 1350 opens faster and remains open for a long time, and thus a large amount of refrigerant may be introduced into the compression chamber P.

However, when a pressure in the intake space 2600 is relatively low at a time at which the intake valve 1350 is opened, an amount of refrigerant introduced into the compression chamber P through the opened intake valve 1350 is reduced. Thus, it is necessary to rapidly increase the pressure in the intake space 2600 according to the time at which the intake valve 1350 is opened.

After the refrigerant is discharged from the compression chamber P, when the piston 1300 moves rearward, that is, toward the bottom dead center, a phenomenon in which the refrigerant is not rapidly introduced into the first muffler 2100 may occur by a volume of the refrigerant remaining between the piston 1300 and the first muffler 2100.

Accordingly, the communication holes 2150 of the first muffler flange 2120 allow the remaining refrigerant to flow rearward and to be discharged from the piston 1300. Hence, when the piston 1300 moves toward the bottom dead center, the communication holes 2150 allow the refrigerant to be rapidly introduced into the first muffler 2100.

FIG. 3 is a cross-sectional view illustrating a flow of a refrigerant suctioned in an intake port of a piston through an intake muffler in a linear compressor according to the prior patent. FIG. 4 is an experimental graph illustrating an increase in an intake flow amount in a linear compressor according to the prior patent, compared to a linear compressor according to a related art.

In FIG. 4, the linear compressor according to the related art refers to a linear compressor in which a communication hole 210 is not included in a first flange 2120.

A refrigerant suctioned by the compressor may flow into the intake muffler 2000 through a through hole 2520 of the third muffler 2500, may sequentially pass through an inlet hole 2320*a* of the second muffler 2300 and an inlet hole 2110*a* of the first muffler 2100, and may be then introduced into the body 2110 of the first muffler 2100.

The refrigerant in the body 2110 of the first muffler 2100 flows into the intake space 2600, and the refrigerant flowing into the intake space 2600 is suctioned into the compression chamber P through an intake port 1330 of the piston 1300 when the intake valve 1350 is opened.

Here, the intake space 2600 may be understood as a space between a body front portion of the piston 1300 and a front end of the first muffler 2100.

When a pressure of the compression chamber P is higher than a pressure of the intake space 2600, the intake valve 1350 is closed, and a volume of the compression chamber P decreases while the piston 1300 moves forward. Hence, the compression of the refrigerant is fulfilled.

Afterwards, when the pressure of the compression chamber P increases and is higher than a pressure of the discharge space, the discharge of the refrigerant is fulfilled while a discharge valve (not shown) is opened.

In this case, a position of the piston 1300 forms top dead center (P1 in FIG. 4) at time to.

When the discharge of the refrigerant is fulfilled, the piston 1300 and the intake muffler 2000 move to the rear, and the refrigerant is suctioned into the intake muffler 2000 as described above. In this instance, since the refrigerant remaining in the inside of the piston 1300, i.e., a space between the piston 1300 and the first muffler 2100 or the intake space 2600 is discharged to the rear through the communication holes 2150 included in the flange 2120 of the first muffler 2100, the refrigerant is rapidly suctioned into the intake muffler 2000.

Accordingly, the decompression of the refrigerant in the intake space 2600 may be reduced.

A discharge space 2110*e* having a flow passage, through which the remaining refrigerant is discharged, is formed between an inner peripheral surface of a piston body 1310 and an outer peripheral surface of the body 2110 of the first muffler 2100.

The refrigerant flows from the intake space 2600 to the rear through the discharge space 2110*e* and is discharged from the first muffler 2100 through the communication holes 2150 provided in the flange 2120 of the first muffler 2100.

As above, in the process in which the piston 1300 moves from top dead center to bottom dead center, a circulation of the refrigerant flow may occur while the discharge and the intake of the refrigerant in the piston 1300 are fulfilled together.

FIG. 4 illustrates a distribution of pressures measured in the intake space in a case of the linear compressor according to the prior patent (indicated by the thick dotted line) and a case of the related art linear compressor in which the communication hole is not provided in the flange of the first muffler in the structure of the intake muffler of the linear compressor according to the prior patent (indicated by the thin dotted line).

When the piston 1300 moves from top dead center P1 toward bottom dead center P2 (at time t3), the pressure in the intake space in the case of the related art linear compressor decreases and then increases again. On the other hand, in the case of the linear compressor according to the prior patent, the pressure in the intake space 2600 at the top dead center P1 is almost kept.

That is, it can be seen from FIG. 4 that the pressure in the intake space 2600 is kept higher by an area 'A' in the linear compressor according to the prior patent than in the related art linear compressor.

In addition, as the pressure in the intake space 2600 is kept relatively high, an amount of refrigerant suctioned into the compression chamber P may increase when the intake valve 1350 is opened.

That is, it can be seen from FIG. 4 that an amount of refrigerant suctioned into the compression chamber P in the linear compressor according to the prior patent (indicated by the thick dotted line) is more than that in the related art linear compressor (indicated by the thin dotted line) by an area 'B'.

In FIG. 4, a time duration from time t1 to time t2 indicates an open duration of the intake valve 1350.

Accordingly, if the communication hole 2150 is provided in the flange 2120 of the first muffler 2100, the refrigerant may be rapidly suctioned through the intake muffler 2000. Hence, since the pressure in the intake space 2600 can be kept relatively high, an amount of refrigerant suctioned in the compression chamber P can increase.

With reference to the pressure distribution of each portion of the muffler illustrated in FIG. 5, since the pressure reduction in the inlet portion of the first muffler 2100 in the prior patent is more improved than that in the related art linear compressor, the pressure reductions in the inlet portion of the first muffler 2100, the outlet portion of the first muffler 2100, and the inlet portion of the intake port 1330 in the prior patent can be more improved than those in the related art linear compressor. However, since a pressure from an inlet guide portion 1560 connected to an inlet of the third muffler 2500, specifically, an intake pipe (not shown) to an inlet of the second muffler 2300 in the prior patent is similar to that in the related art linear compressor, there is a problem in that the overall improvement effect of the pressure reduction is low, and the compression efficiency of the linear motor cannot be effectively improved.

SUMMARY

An object of the present disclosure is to provide a linear compressor capable of effectively improving a pressure reduction at an inlet side of an intake muffler.

Another object of the present disclosure is to provide a linear compressor capable of generating a high pressure at an outlet side of an intake muffler.

Another object of the present disclosure is to provide a linear compressor capable of effectively improving a compression efficiency.

To achieve the above-described and other objects of the present disclosure, in one aspect, there is provided a linear compressor comprising a first muffler disposed in a piston body, a second muffler disposed below the first muffler and configured to communicate with the first muffler, and a third muffler configured to accommodate a portion of a rear end of the first muffler and the second muffler, wherein each of the first muffler and the second muffler includes (i) a body that defines a refrigerant flow passage and extends in an axial direction, and (ii) a flange that extends radially from the body, and wherein the flange of the first muffler and the flange of the second muffler each include a communication portion.

Accordingly, the refrigerant remaining in a discharge space formed between the piston body and the body of the first muffler flows into an inner space of the third muffler through the communication portions of the first muffler and the second muffler, when a piston moves from top dead center to bottom dead center.

The communication portion of the first muffler and the communication portion of the second muffler each may include a communication hole provided in the corresponding flange, and may further include a communication pipe communicating with the corresponding communication hole.

The linear compressor including the intake muffler according to embodiments of the present disclosure provides a communication portion communicating with the communication portion (communication hole) provided in the flange of the first muffler to the flange of the second muffler, and can further improve a pressure reduction at an inlet portion of the third muffler compared to the prior patent.

As the pressure reduction at the inlet portion of the third muffler is improved, a pressure reduction at an inlet portion of the first muffler, an outlet portion of the first muffler, and an inlet portion of an intake port can be further improved compared to the prior patent.

Accordingly, since a pressure reduction at an inlet end of the intake muffler can be further improved compared to the prior patent, and a pressure at an outlet end of the intake muffler can be generated higher than the prior patent, the present disclosure can efficiently improve compression efficiency compared to the prior patent.

BRIEF DESCRIPTION OF THE DRAWINGS

The accompanying drawings, which are included to provide a further understanding of the present disclosure and constitute a part of the detailed description, illustrate embodiments of the present disclosure and serve to explain technical features of the present disclosure together with the description.

DETAILED DESCRIPTION

Reference will now be made in detail to embodiments of the present disclosure, examples of which are illustrated in the accompanying drawings. Wherever possible, the same reference numbers will be used throughout the drawings to refer to the same or like parts.

It should be understood that when a component is described as being "connected to" or "coupled to" other component, it may be directly connected or coupled to the other component or intervening component(s) may be present.

It will be noted that a detailed description of known arts will be omitted if it is determined that the detailed description of the known arts can obscure embodiments of the present disclosure. The accompanying drawings are used to help easily understand various technical features and it should be understood that embodiments presented herein are not limited by the accompanying drawings. As such, the present disclosure should be understood to extend to any alterations, equivalents and substitutes in addition to those which are particularly set out in the accompanying drawings.

In addition, a term of "disclosure" may be replaced by document, specification, description, etc.

Figure 1:
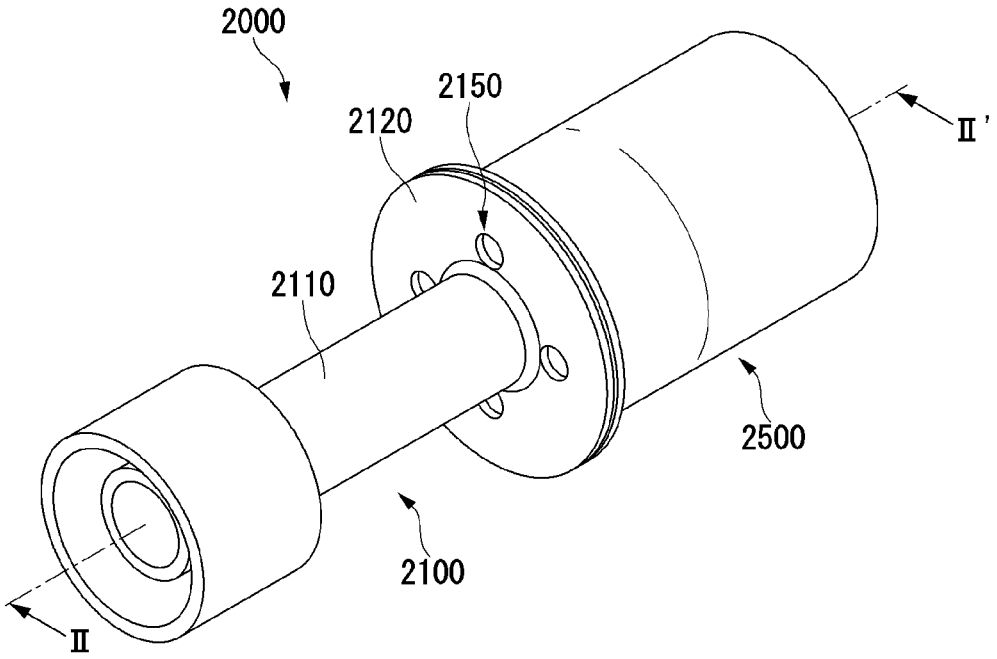
FIG. 1 is a perspective view illustrating configuration of an intake muffler according to the prior patent.
Figure 2:
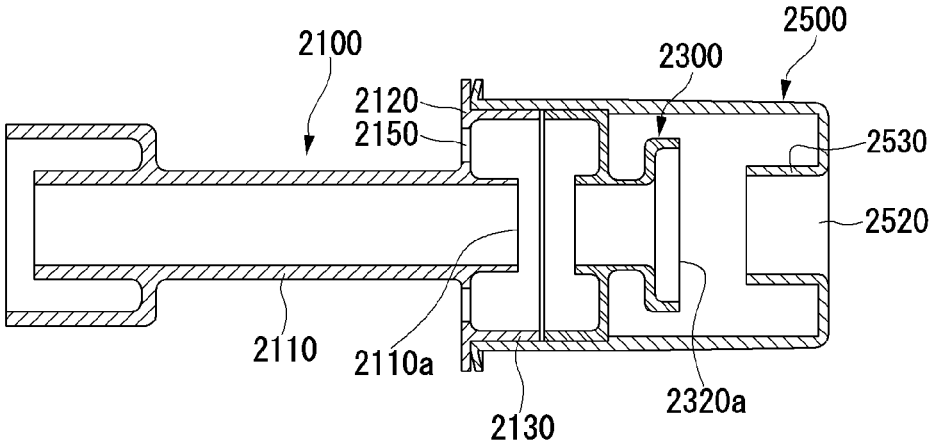
FIG. 2 is a cross-sectional view taken along II-IF of FIG. 1.
Figure 3:
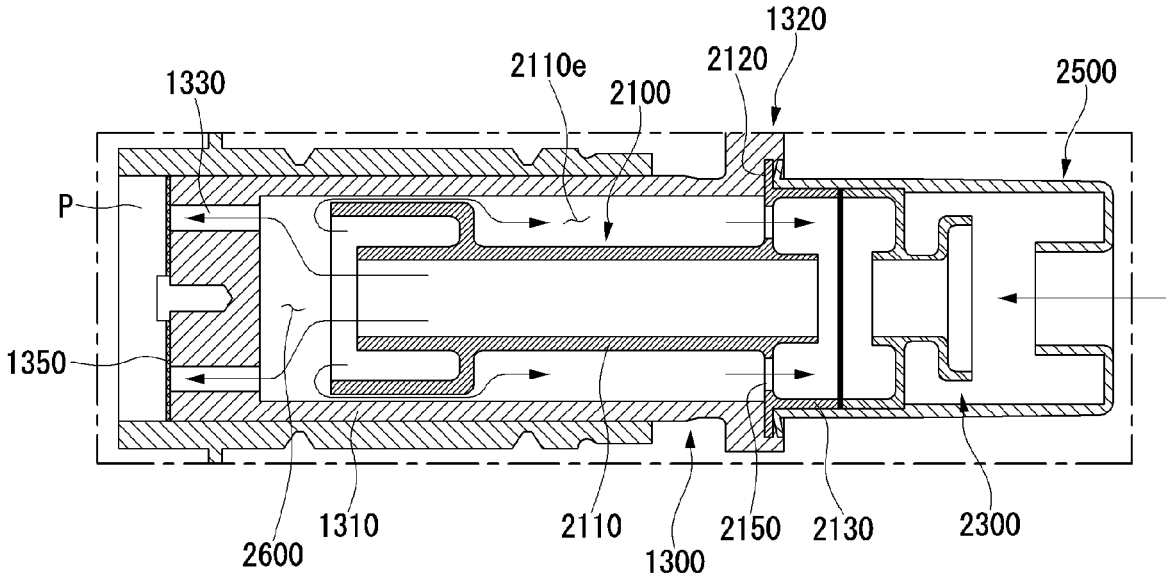
FIG. 3 is a cross-sectional view illustrating a flow of a refrigerant suctioned into an intake port of a piston through an intake muffler according to a prior patent.
Figure 4:
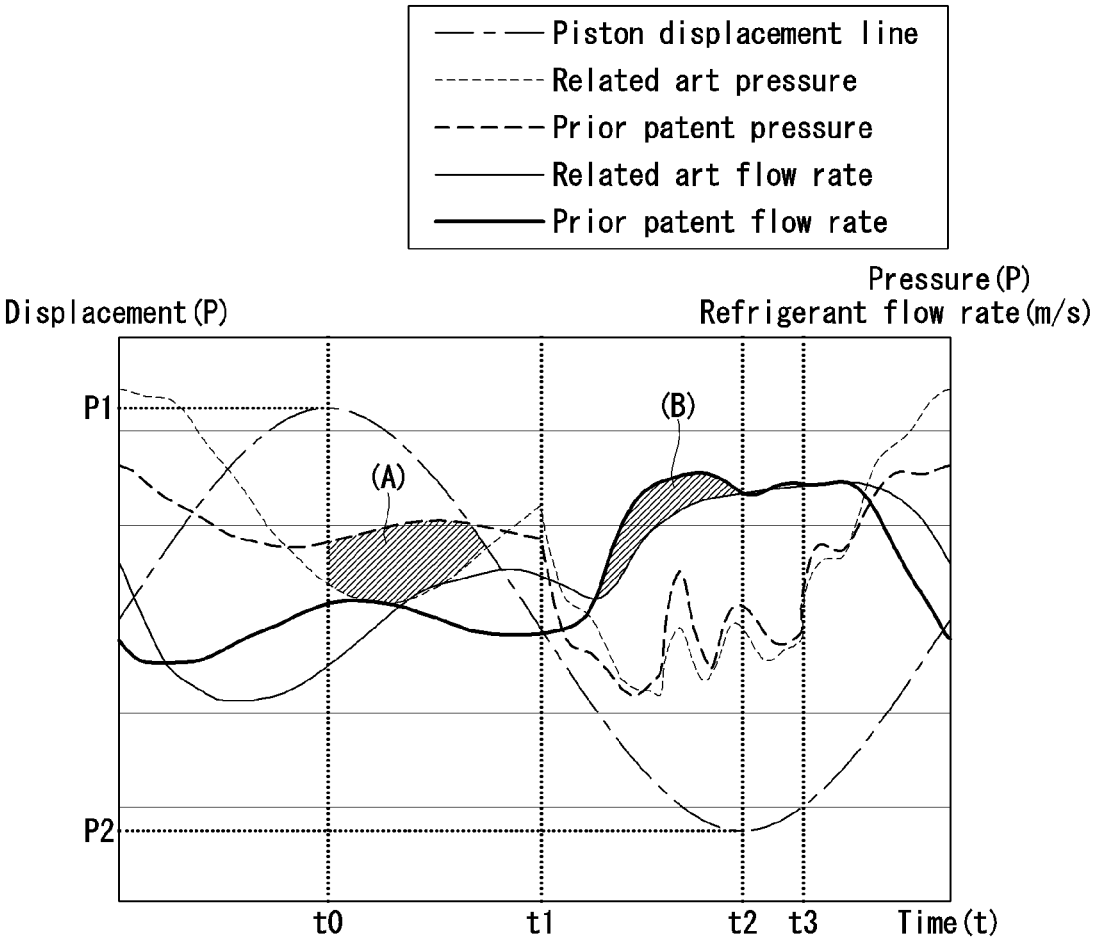
FIG. 4 is an experimental graph illustrating an increase in an intake flow amount in a linear compressor adopting an intake muffler according to a prior patent, compared to a linear compressor according to a related art.
Figure 5:
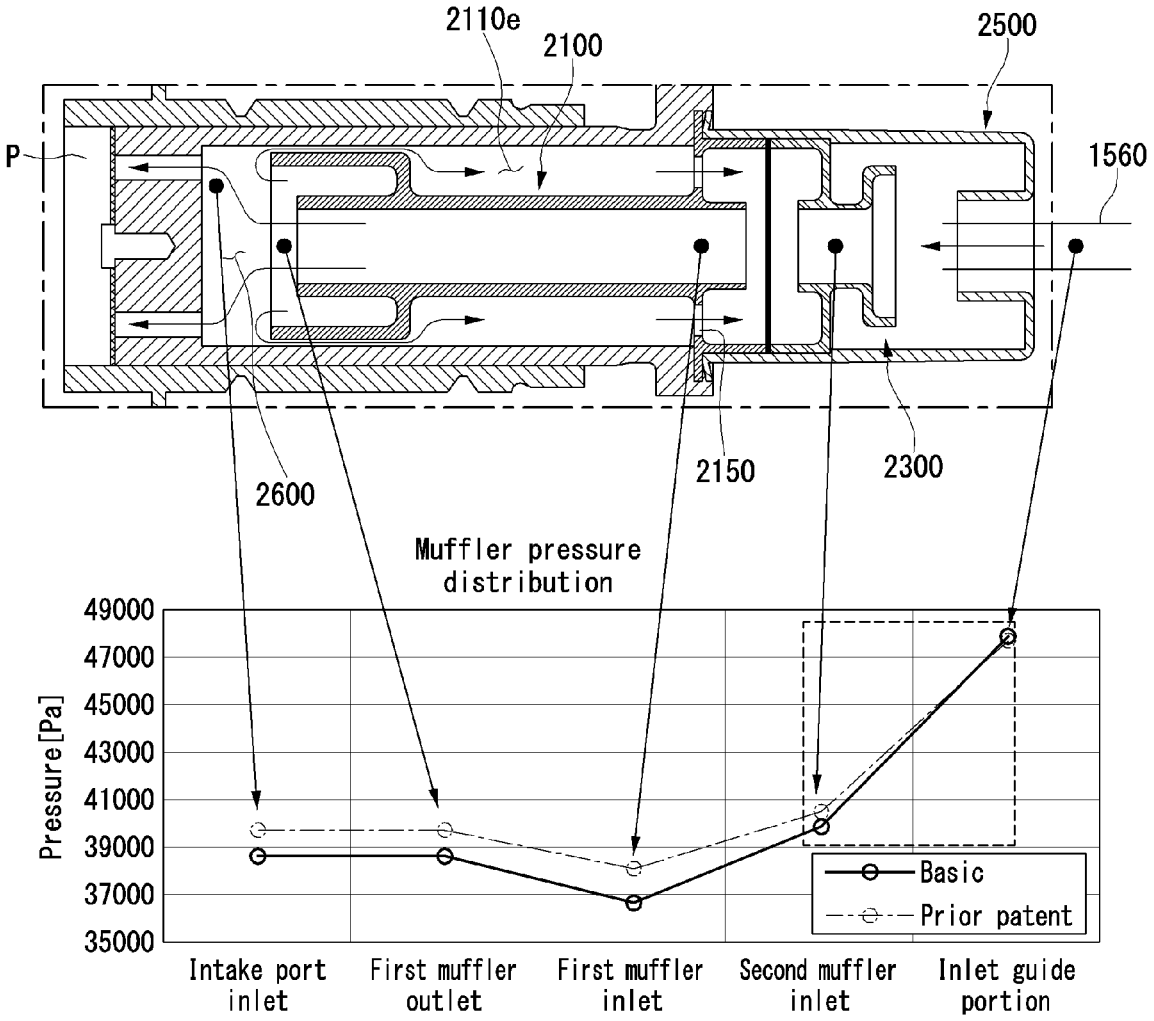
FIG. 5 is an experimental graph illustrating an improvement in a pressure reduction in a linear compressor adopting an intake muffler according to a prior patent, compared to a linear compressor according to a related art.
Figure 6:
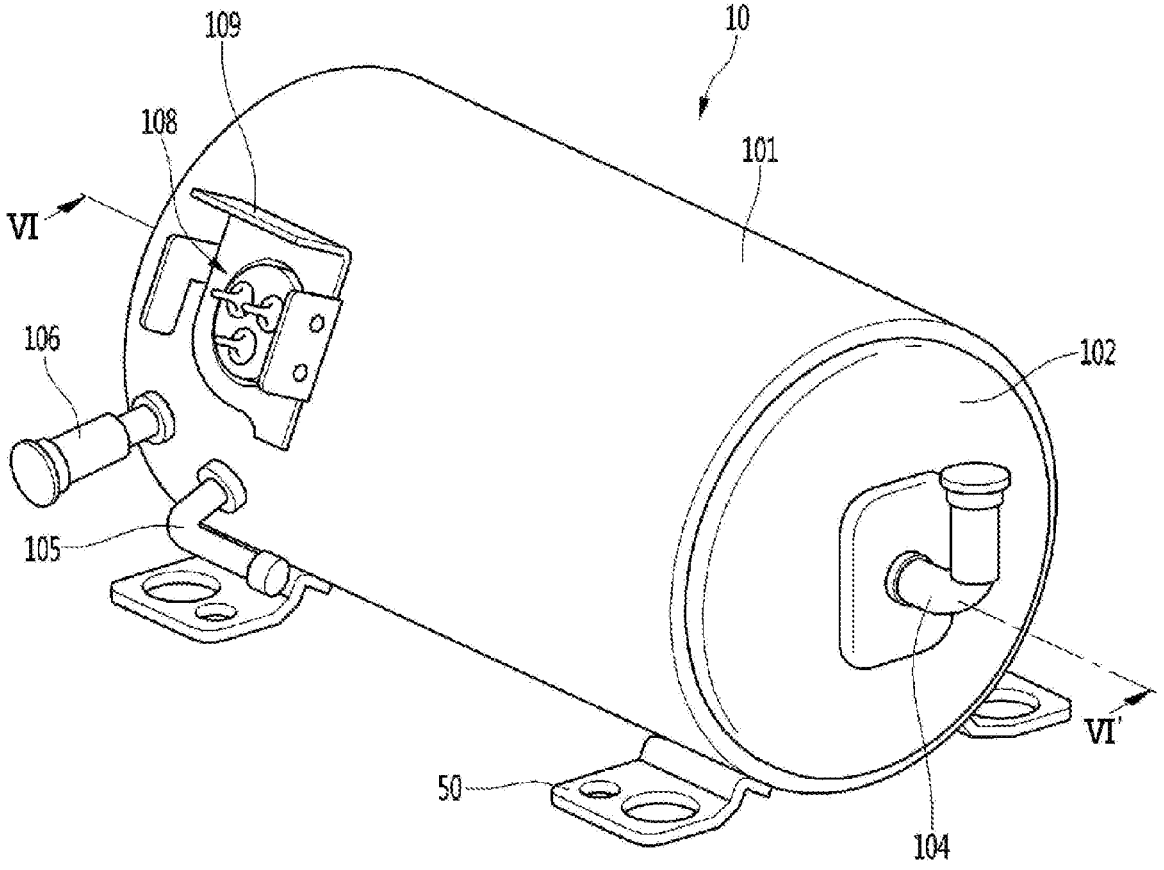
FIG. 6 is an appearance perspective view illustrating configuration of a linear compressor according to an embodiment of the present disclosure.
Figure 7:
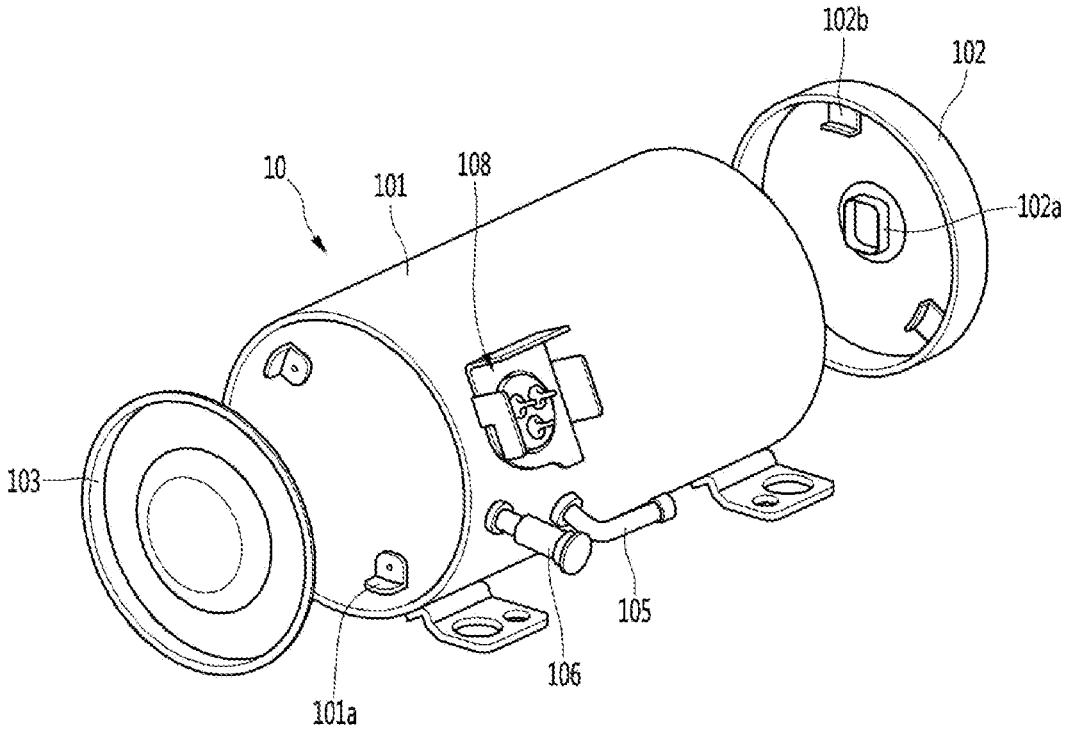
FIG. 7 is an exploded perspective view of a shell and a shell cover of a linear compressor according to an embodiment of the present disclosure.
Figure 8:
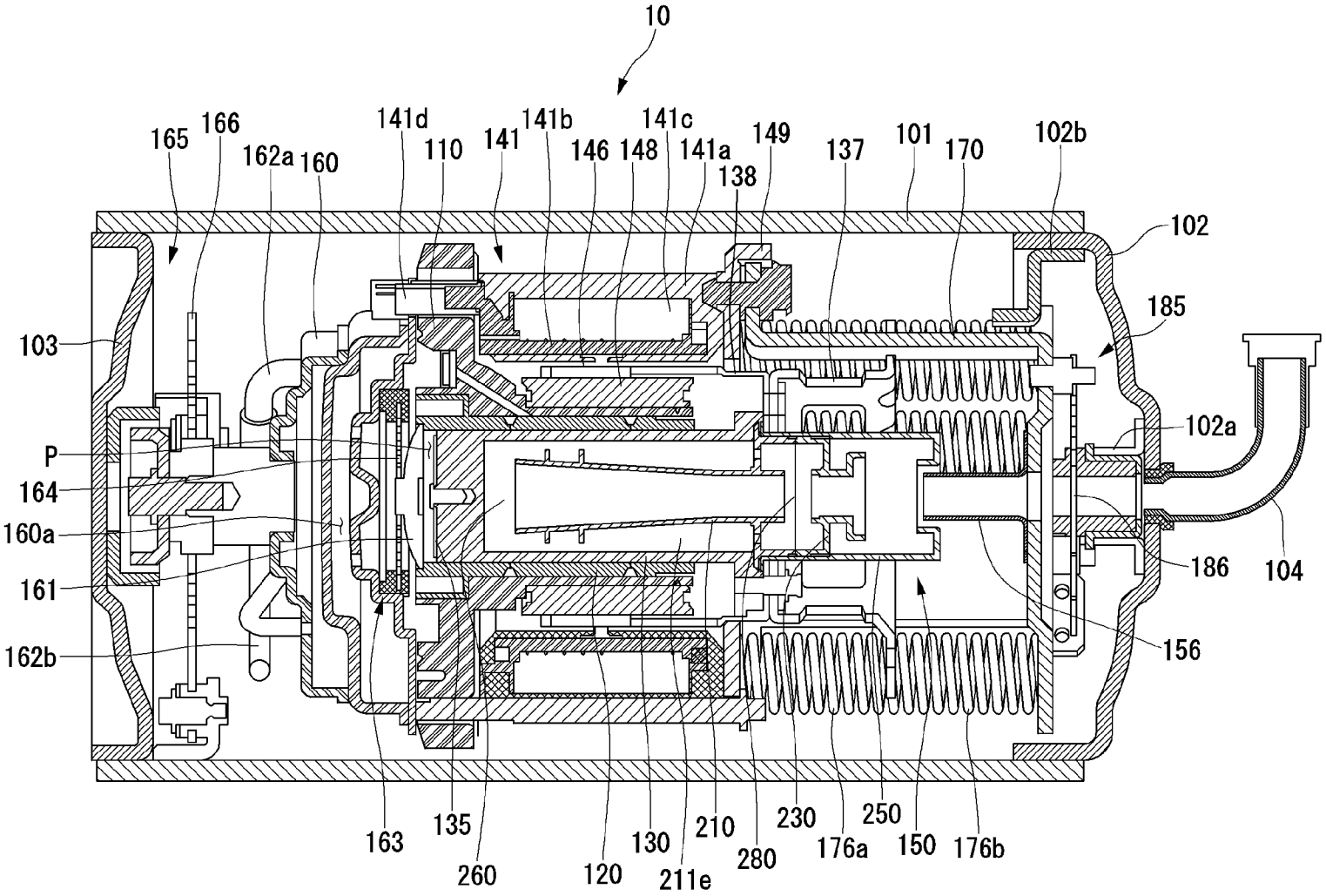
FIG. 8 is a cross-sectional view taken along VI-VI' of FIG. 6.

FIG. 6 is an appearance perspective view illustrating configuration of a linear compressor according to an embodiment of the present disclosure. FIG. 7 is an exploded perspective view of a shell and a shell cover of a linear compressor according to an embodiment of the present disclosure. FIG. 8 is a cross-sectional view taken along VI-VI' of FIG. 6.

Referring to the figures, a linear compressor 10 according to an embodiment of the present disclosure includes a shell 101 and shell covers 102 and 103 coupled to the shell 101.

In a broad sense, the first shell cover 102 and the second shell cover 103 can be understood as one configuration of the shell 101.

Legs 50 may be coupled to a lower side of the shell 101. The legs 50 may be coupled to a base of a product in which the linear compressor 10 is installed. Examples of the product may include a refrigerator, and the base may include a machine room base of the refrigerator. As another example, the product may include an outdoor unit of an air conditioner, and the base may include a base of the outdoor unit.

The shell 101 may have a substantially cylindrical shape and may be disposed in a transverse direction or a horizontal direction or an axial direction. FIG. 6 illustrates that the shell 101 is extended in the horizontal direction and has a slightly low height in a radial direction, by way of example.

That is, since the linear compressor 10 can have a low height, there is an advantage in that a height of the machine room can decrease when the linear compressor 10 is installed in the machine room base of the refrigerator.

A terminal 108 may be installed on an outer surface of the shell 101. The terminal 108 is understood as configuration to transmit external electric power to a motor assembly of the linear compressor 10. The terminal 108 may be connected to a lead line of a coil 141*c* (see FIG. 8).

A bracket 109 is installed outside the terminal 108. The bracket 109 may include a plurality of brackets surrounding the terminal 108. The bracket 109 can perform a function of protecting the terminal 108 from an external impact, etc.

Both sides of the shell 101 are configured to be opened. The shell covers 102 and 103 may be coupled to both sides of the opened shell 101.

The shell covers 102 and 103 include the first shell cover 102 coupled to one opened side of the shell 101 and the second shell cover 103 coupled to the other opened side of the shell 101. An inner space of the shell 101 may be sealed by the shell covers 102 and 103.

FIG. 6 illustrates that the first shell cover 102 is positioned on the right side of the linear compressor 10, and the second shell cover 103 is positioned on the left side of the linear compressor 10, by way of example. Thus, the first and second shell covers 102 and 103 may be disposed to face each other.

The linear compressor 10 further includes a plurality of pipes 104, 105, and 106 that are included in the shell 101 or the shell covers 102 and 103 and may suction, discharge, or inject the refrigerant.

The plurality of pipes 104, 105, and 106 include an intake pipe 104 that allows the refrigerant to be suctioned into the linear compressor 10, a discharge pipe 105 that allows the compressed refrigerant to be discharged from the linear compressor 10, and a process pipe 106 for supplementing the refrigerant in the linear compressor 10.

The intake pipe 104 may be coupled to the first shell cover 102. The refrigerant may be suctioned into the linear compressor 10 along the axial direction through the intake pipe 104.

The discharge pipe 105 may be coupled to an outer peripheral surface of the shell 101. The refrigerant suctioned through the intake pipe 104 may be compressed while flowing in the axial direction. The compressed refrigerant may be discharged through the discharge pipe 105. The discharge pipe 105 may be disposed closer to the second shell cover 103 than to the first shell cover 102.

The process pipe 106 may be coupled to the outer peripheral surface of the shell 101. A worker may inject the refrigerant into the linear compressor 10 through the process pipe 106.

The process pipe 106 may be coupled to the shell 101 at a different height from the discharge pipe 105 in order to prevent interference with the discharge pipe 105. Herein, the "height" may be understood as a distance measured from the leg 50 in a vertical direction (or a radial direction).

On an inner peripheral surface of the shell 101 corresponding to a location at which the process pipe 106 is coupled, at least a portion of the second shell cover 103 may be positioned adjacently. In other words, at least a portion of the second shell cover 103 may act as a resistance of the refrigerant injected through the process pipe 106.

Thus, with respect to a flow passage of the refrigerant, a size of the flow passage of the refrigerant introduced through the process pipe 106 may be configured to decrease while the refrigerant enters into the inner space of the shell 101.

In this process, a pressure of the refrigerant may be reduced to vaporize the refrigerant, and an oil contained in the refrigerant may be separated. Thus, while the refrigerant, from which the oil is separated, is introduced into a piston 130, a compression performance of the refrigerant can be improved. The oil may be understood as a working oil present in a cooling system.

A cover support portion 102*a* is provided at the inner surface of the first shell cover 102. A second support device 185 to be described later may be coupled to the cover support portion 102*a*. The cover support portion 102*a* and the second support device 185 may be understood as devices for supporting the main body of the linear compressor 10.

Here, the main body of the compressor refers to a component provided inside the shell 101, and may include, for example, a driver that reciprocates forward and rearward and a support portion supporting the driver.

The driver may include a piston 130, a magnet frame 138, a permanent magnet 146, a supporter 137, an intake muffler 200, and the like. The support portion may include resonance springs 176*a* and 176*b*, a rear cover 170, a stator cover 149, a first support device 165, and a second support device 185, and the like.

A stopper 102*b* may be provided at the inner surface of the first shell cover 102. The stopper 102*b* is understood as configuration to prevent the main body of the compressor 10, in particular, a motor assembly (not shown) from being damaged by colliding with the shell 101 due to a vibration or an impact, etc. generated during transportation of the linear compressor 10.

The stopper 102*b* is positioned adjacent to the rear cover 170 to be described later. The stopper 102*b* can prevent an impact from being transferred to the motor assembly (not shown) since the rear cover 170 interferes with the stopper 102*b* when shaking occurs in the linear compressor 10.

A spring fastening portion 101*a* may be provided on the inner peripheral surface of the shell 101. The spring fastening portion 101*a* may be disposed adjacent to the second shell cover 103. The spring fastening portion 101*a* may be coupled to a first support spring 166 of a first support device 165 to be described later. As the spring fastening portion 101*a* and the first support device 165 are coupled, the main body of the compressor may be stably supported inside the shell 101.

Figure 9:
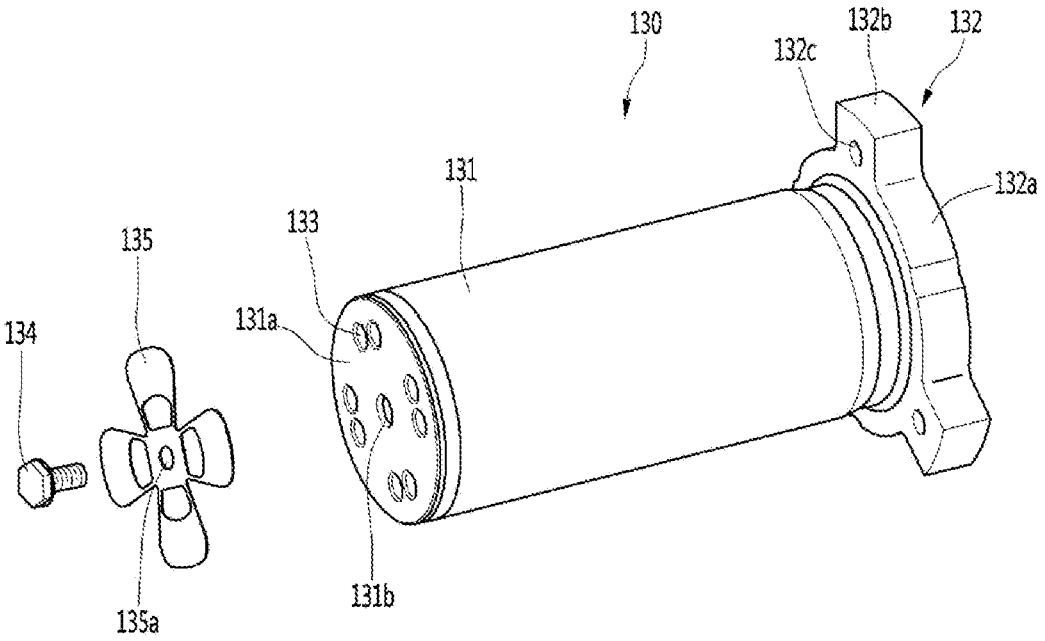
FIG. 9 is an exploded perspective view illustrating configuration of a piston assembly according to an embodiment of the present disclosure.

FIG. 8 is a cross-sectional view taken along VI-VI' of FIG. 6. FIG. 9 is an exploded perspective view illustrating configuration of a piston assembly according to an embodiment of the present disclosure.

Referring to FIGS. 8 and 9, the linear compressor 10 according to an embodiment of the present disclosure includes a cylinder 120 provided in the shell 101, a piston 130 that linearly reciprocates in the cylinder 120, and a motor assembly (not shown) including a linear motor that gives a driving force to the piston 130.

When the motor assembly (not shown) drives, the piston 130 may reciprocate in the axial direction.

The linear compressor 10 further includes an intake muffler 200 coupled to the piston 130. The intake muffler 200 can reduce a noise generated from a refrigerant suctioned through an intake pipe 104.

The refrigerant suctioned through the intake pipe 104 passes through the intake muffler 200 and flows into the piston 130. For example, in a process in which the refrigerant passes through the intake muffler 200, the flow noise of the refrigerant can be reduced.

The intake muffler 200 includes a plurality of mufflers 210, 230, and 250. The plurality of mufflers 210, 230, and 250 include a first muffler 210, a second muffler 230, and a third muffler 250 that are coupled to each other.

The first muffler 210 is positioned in the piston 130, and the second muffler 230 is coupled to the rear of the first muffler 210. The third muffler 250 may accommodate the second muffler 230 therein and may extend to the rear of the first muffler 210.

From a perspective of the flow direction of the refrigerant, the refrigerant suctioned through the intake pipe 104 may sequentially pass through the third muffler 250, the second muffler 230, and the first muffler 210. In this process, the flow noise of the refrigerant can be reduced.

The intake muffler 200 further includes a muffler filter 280. The muffler filter 280 may be positioned at an interface where the first muffler 210 and the second muffler 230 are coupled. For example, the muffler filter 280 may have a circular shape, and an outer peripheral portion of the muffler filter 280 may be supported between the first and second mufflers 210 and 230.

In the present disclosure, "axial direction (or axially)" may be understood as a direction in which the piston 130 reciprocates, i.e., a longitudinal direction in FIG. 8. In the "axial direction", a direction directed from the intake pipe 104 to a compression chamber P, i.e., a direction in which the refrigerant flows may be understood as "front", and the opposite direction thereof may be understood as "rear".

On the other hand, "radial direction (or radially)" may be understood as a direction perpendicular to the direction in which the piston 130 reciprocates, i.e., a transverse direction in FIG. 8.

The piston 130 includes a piston body 131 having a substantially cylindrical shape and a piston flange 132 extending radially from the piston body 131.

The piston body 131 may reciprocate axially inside the cylinder 120, and the piston flange 132 may reciprocate axially outside the cylinder 120.

The cylinder 120 is configured to accommodate at least a portion of the first muffler 210 and at least a portion of the piston body 131.

The compression chamber P in which the refrigerant is compressed by the piston 130 is formed in the cylinder 120. An intake port 133 that introduces the refrigerant into the compression chamber P is formed at a front surface of the piston body 131, and an intake valve 135 that selectively opens the intake port 133 is provided at the front of the intake port 133. A second fastening hole 135*a* to which a valve fastening member 134 is coupled is formed at approximately the center of the intake valve 135.

The valve fastening member 134 may be understood as configuration to couple the intake valve 135 to a first fastening hole 131*b* of the piston 130. The first fastening hole 131*b* is formed at approximately the center of a front end surface of the piston 130. The valve fastening member 134 may pass through the second fastening hole 135*a* of the intake valve 135 and may be coupled to the first fastening hole 131*b*.

The piston 130 includes the piston body 131 that has a substantially cylindrical shape and extends forward and rearward, and the piston flange 132 extending radially outwardly from the piston body 131.

A body front portion 131*a* in which the first fastening hole 131*b* is formed is provided at the front of the piston body 131. The intake port 133 selectively shielded by the intake valve 135 is formed at the body front portion 131*a*. The intake port 133 includes a plurality of intake ports, and the plurality of intake ports 133 are formed outside the first fastening hole 131*b*.

The plurality of intake ports 133 may be disposed to surround the first fastening hole 131*b*. For example, the eight intake ports 133 may be provided.

A rear portion of the piston body 131 is opened so that the intake of the refrigerant is fulfilled. At least a portion of the intake muffler 200, i.e., the first muffler 210 may be inserted into the piston body 131 through the opened rear portion of the piston body 131.

The piston flange 132 includes a flange body 132*a* extending radially outwardly from the rear portion of the piston body 131, and a piston fastening portion 132*b* further extending radially outwardly from the flange body 132*a*.

The piston fastening portion 132*b* includes a piston fastening hole 132*c* to which a predetermined fastening member is coupled. The fastening member may pass through the piston fastening hole 132*c* and may be coupled to a magnet frame 138 and a supporter 137. The piston fastening portion 132*b* may include a plurality of piston fastening portions 132*b*, and the plurality of piston fastening portions 132*b* may be spaced apart from each other and disposed at an outer peripheral surface of the flange body 132*a*.

At the front of the compression chamber P, a discharge cover 160 forming a discharge space 160*a* of the refrigerant discharged from the compression chamber P, and discharge valve assemblies 161 and 163 that are coupled to the discharge cover 160 and selectively discharge the refrigerant compressed in the compression chamber P are provided. The discharge space 160*a* includes a plurality of spaces partitioned by an inner wall of the discharge cover 160. The plurality of spaces may be disposed forward and rearward and may communicate with each other.

The discharge valve assemblies 161 and 163 include a discharge valve 161 that is opened when a pressure of the compression chamber P is greater than or equal to a discharge pressure, and introduces the refrigerant into the discharge space 160*a* of the discharge cover 160, and a spring assembly 163 that is provided between the discharge valve 161 and the discharge cover 160 and provides axially an elastic force.

The spring assembly 163 may include a valve spring (not shown) and a spring support portion (not shown) for supporting the valve spring (not shown) to the discharge cover 160.

For example, the valve spring (not shown) may be formed as a leaf spring. The spring support portion (not shown) may be integrally injection-molded with the valve spring (not shown) by an injection process.

The discharge valve 161 is coupled to the valve spring (not shown), and a rear portion or a rear surface of the discharge valve 161 is positioned so that it is supportable to the front surface of the cylinder 120.

When the discharge valve 161 is supported to the front surface of the cylinder 120, the compression chamber P may maintain a sealed state. When the discharge valve 161 is spaced apart from the front surface of the cylinder 120, the compression chamber P may be opened, and the compressed refrigerant inside the compression chamber P may be discharged.

The compression chamber P may be defined as a space between the intake valve 135 and the discharge valve 161.

The intake valve 135 may be formed on one side of the compression chamber P, and the discharge valve 161 may be provided on other side of the compression chamber P, that is, on the opposite side of the intake valve 135.

In the process in which the piston 130 reciprocates linearly in the axial direction inside the cylinder 120, when the pressure of the compression chamber P is lower than the discharge pressure and is less than or equal to an intake pressure, the discharge valve 161 is closed and the intake valve 135 is opened. Hence, the refrigerant is suctioned into the compression chamber P.

On the other hand, when the pressure of the compression chamber P is greater than or equal to the intake pressure, the refrigerant in the compression chamber P is compressed in the closed state of the intake valve 135.

When the pressure of the compression chamber P is greater than or equal to the intake pressure, the valve spring (not shown) is deformed forward to open the discharge valve 161, and the refrigerant is discharged from the compression chamber P and is discharged into the discharge space 160*a* of the discharge cover 160.

When the discharge of the refrigerant is completed, the valve spring (not shown) provides a restoring force to the discharge valve 161, and thus the discharge valve 161 is closed.

The linear compressor 10 further includes a cover pipe 162*a* that is coupled to the discharge cover 160 and discharges the refrigerant flowing in the discharge space 160*a* of the discharge cover 160. For example, the cover pipe 162*a* may be made of a metal material.

The linear compressor 10 further includes a loop pipe 162*b* that is coupled to the cover pipe 162*a* and transfers the refrigerant flowing through the cover pipe 162*a* to the discharge pipe 105. One side of the loop pipe 162*b* may be coupled to the cover pipe 162*a*, and other side may be coupled to the discharge pipe 105.

The loop pipe 162*b* may be made of a flexible material. The loop pipe 162*b* may roundly extend from the cover pipe 162*a* along the inner peripheral surface of the shell 101 and may be coupled to the discharge pipe 105. For example, the loop pipe 162*b* may have a wound shape.

The linear compressor 10 further includes a frame 110 fixing the cylinder 120. For example, the cylinder 120 may be press-fitted to the inside of the frame 110. The cylinder 120 and the frame 110 may be made of aluminum or an aluminum alloy material.

The frame 110 is disposed to surround the cylinder 120. That is, the cylinder 120 may be positioned to be accommodated inside the frame 110. The discharge cover 160 may be coupled to a front surface of the frame 110 by a fastening member.

The motor assembly (not shown) includes an outer stator 141 that is fixed to the frame 110 and is disposed to surround the cylinder 120, an inner stator 148 that is disposed to be spaced apart from the inside of the outer stator 141, and a permanent magnet 146 positioned in a space between the outer stator 141 and the inner stator 148.

The permanent magnet 146 may reciprocate linearly by a mutual electromagnetic force between the permanent magnet 146 and the outer stator 141 and the inner stator 148. The permanent magnet 146 may be composed of a single magnet having one pole, or may be configured by combining a plurality of magnets having three poles.

The permanent magnet 146 may be installed in the magnet frame 138. The magnet frame 138 has a substantially cylindrical shape and may be inserted into a space between the outer stator 141 and the inner stator 148.

Based on the cross-sectional view of FIG. 8, the magnet frame 138 may be coupled to the piston flange 132, extended outward in the radial direction, and bent forward. The permanent magnet 146 may be installed in a front portion of the magnet frame 138.

When the permanent magnet 146 reciprocates, the piston 130 may reciprocate axially along with the permanent magnet 146.

The outer stator 141 includes coil winding bodies 141*b*, 141*c*, and 141*d* and a stator core 141*a*. The coil winding bodies 141*b*, 141*c*, and 141*d* include a bobbin 141*b* and a coil 141*c* wound in a circumferential direction of the bobbin 141*b*.

The coil winding bodies 141*b*, 141*c*, and 141*d* further include a terminal portion 141*d* for guiding a power supply line connected to the coil 141*c* to be withdrawn or exposed to the outside of the outer stator 141. The terminal portion 141*d* may be disposed to be inserted into a terminal insertion portion of the frame 110.

The stator core 141*a* includes a plurality of core blocks that is configured such that a plurality of laminations is stacked in a circumferential direction. The plurality of core blocks may be disposed to surround at least a portion of the coil winding bodies 141*b* and 141*c*.

The stator cover 149 is provided on one side of the outer stator 141. That is, one side of the outer stator 141 may be supported by the frame 110, and other side may be supported by the stator cover 149.

The linear compressor 10 further includes a cover fastening member (not shown) for fastening the stator cover 149 to the frame 110. The cover fastening member (not shown) may pass through the stator cover 149, extend forward toward the frame 110, and may be coupled to a first fastening hole of the frame 110.

The inner stator 148 is fixed to the outer periphery of the frame 110. Further, the inner stator 148 is configured such that a plurality of laminations is stacked in a circumferential direction from the outside of the frame 110.

The linear compressor 10 further includes a supporter 137 supporting the piston 130. The supporter 137 is coupled to the rear side of the piston 130, and the intake muffler 200 may be disposed inside the supporter 137 to pass therethrough.

The piston flange 132, the magnet frame 138, and the supporter 137 may be fastened by a fastening member.

A balance weight (not shown) may be coupled to the supporter 137. A weight of the balance weight (not shown) may be determined based on an operating frequency range of the compressor body.

The linear compressor 10 further includes a rear cover 170 that is coupled to the stator cover 149, extends rearward, and is supported by the second support device 185.

The rear cover 170 includes three support legs, and the three support legs may be coupled to the rear surface of the stator cover 149. A spacer (not shown) may be interposed between the three support legs and the rear surface of the stator cover 149.

A distance from the stator cover 149 to a rear end of the rear cover 170 may be determined by adjusting a thickness of the spacer (not shown). The rear cover 170 may be elastically supported by the supporter 137.

The linear compressor 10 further includes an inlet guide portion 156 that is coupled to the rear cover 170 and guides the introduction of the refrigerant into the intake muffler 200. At least a portion of the inlet guide portion 156 may be inserted into the inside of the intake muffler 200.

The linear compressor 10 further includes a plurality of resonance springs 176*a* and 176*b* in which each natural frequency is adjusted so that the piston 130 can perform a resonant motion.

The plurality of resonance springs 176*a* and 176*b* include a first resonance spring 176*a* supported between the supporter 137 and the stator cover 149 and a second resonance spring 176*b* supported between the supporter 137 and the rear cover 170.

By the action of the plurality of resonance springs 176*a* and 176*b*, a stable movement of the driver reciprocating in the linear compressor 10 can be performed, and generation of vibration or noise caused by the movement of the driver can be reduced.

The supporter 137 includes a first spring support portion (not shown) coupled to the first resonance spring 176*a*.

The linear compressor 10 further includes a first support device 165 that is coupled to the discharge cover 160 and supports one side of the main body of the compressor 10. The first support device 165 may be disposed adjacent to the second shell cover 103 to elastically support the main body of the compressor 10.

The first support device 165 includes a first support spring 166. The first support spring 166 may be coupled to the spring fastening portion 101*a*.

The linear compressor 10 further includes a second support device 185 that is coupled to the rear cover 170 and supports other side of the main body of the compressor 10. The second support device 185 may be coupled to the first shell cover 102 to elastically support the main body of the compressor 10.

The second support device 185 includes a second support spring 186.

The second support spring 186 may be coupled to the cover support portion 102*a*.

Figure 10:
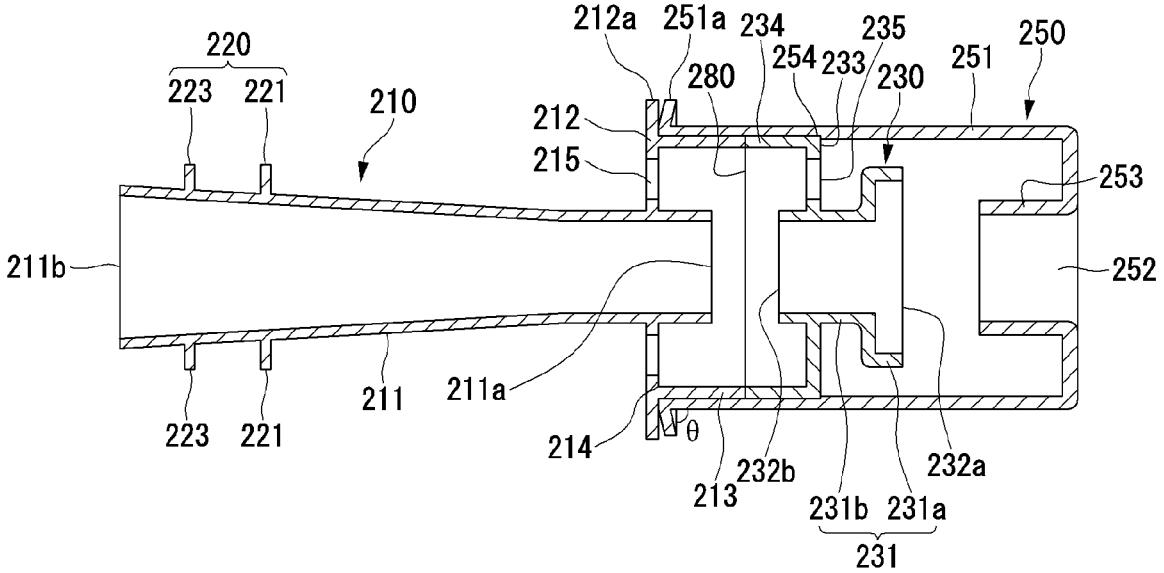
FIG. 10 is a cross-sectional view of an intake muffler according to a first embodiment of the present disclosure.
Figure 11:
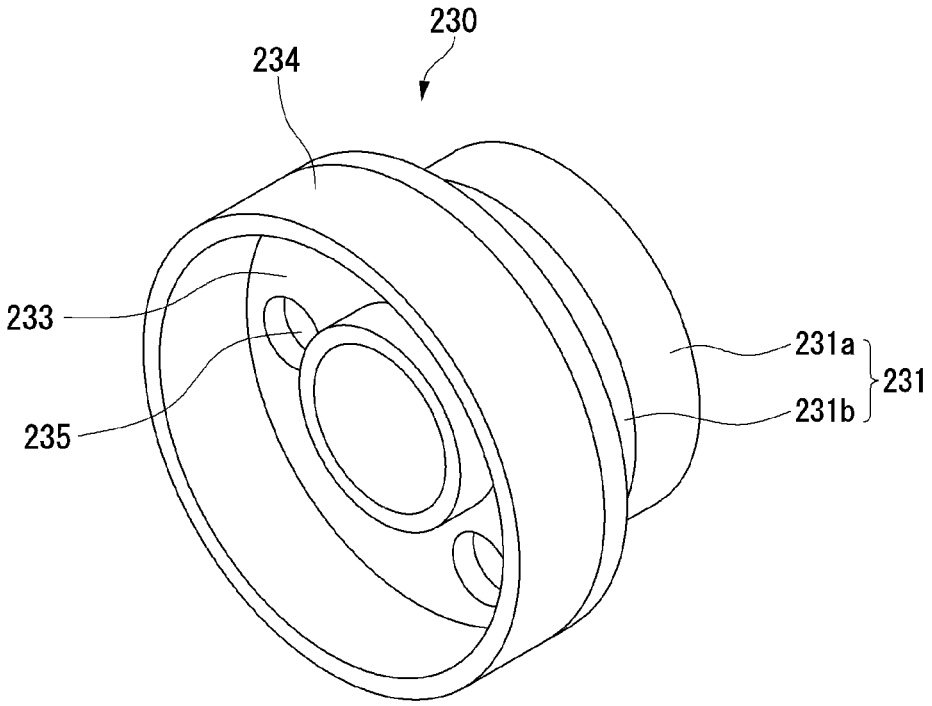
FIG. 11 is a perspective view of a second muffler included in an intake muffler according to a first embodiment of the present disclosure.
Figure 12:
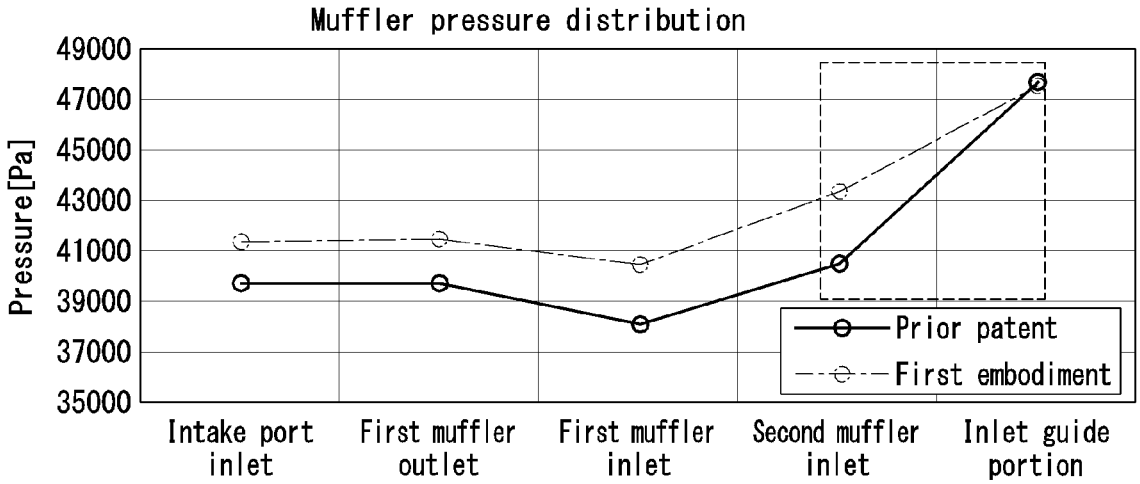
FIG. 12 is an experimental graph illustrating an improvement in a pressure reduction in a linear compressor adopting an intake muffler according to a first embodiment illustrated in FIG. 10, compared to a linear compressor according to a prior patent.

FIG. 10 is a cross-sectional view of an intake muffler according to a first embodiment of the present disclosure. FIG. 11 is a perspective view of a second muffler illustrated in FIG. 10. FIG. 12 is an experimental graph illustrating an improvement in a pressure reduction in a linear compressor adopting an intake muffler according to a first embodiment illustrated in FIG. 10, compared to a linear compressor according to a prior patent.

Referring to FIGS. 10 to 12, an intake muffler 200 according to an embodiment of the present disclosure includes a plurality of mufflers 210, 230, and 250. The plurality of mufflers 210, 230, and 250 may be press-fitted and coupled to each other.

The plurality of mufflers 210, 230, and 250 may be made of a plastic material and easily press-fitted and coupled to each other. Hence, and a heat loss through the plurality of mufflers 210, 230, and 250 in the flow process of the refrigerant can be reduced.

The intake muffler 200 includes a first muffler 210, a second muffler 230 coupled to the rear of the first muffler 210, a muffler filter 280 supported by the first muffler 210 and the second muffler 230, and a third muffler 250 that is coupled to the first and second mufflers 210 and 230 and into which the inlet guide portion 156 is inserted. The third muffler 250 extends to the rear of the second muffler 230.

The third muffler 250 includes a body 251 having a cylindrical shape with an empty interior. The body 251 of the third muffler 250 extends forward and rearward. A through hole 252, into which the inlet guide portion 156 is inserted, is formed in a rear surface of the third muffler 250. The through hole 252 may be defined as an "inlet hole" guiding the introduction of the refrigerant into the intake muffler 200.

The third muffler 250 further includes a protrusion 253 extending forward from the rear surface of the third muffler 250. The protrusion 253 extends forward from an outer peripheral portion of the through hole 252, and the inlet guide portion 156 may be inserted into the inside of the protrusion 253.

The first and second mufflers 210 and 230 may be coupled to each other inside the third muffler 250. For example, the first and second mufflers 210 and 230 may be press-fitted and coupled to an inner peripheral surface of the third muffler 250. A stepped portion 254, to which the second muffler 230 is coupled, is formed at the inner peripheral surface of the third muffler 250.

When the second muffler 230 moves into the third muffler 250 and is press-fitted to the third muffler 250, the second muffler 230 may be caught in the stepped portion 254. Thus, the stepped portion 254 may be understood as a stopper for limiting the rearward movement of the second muffler 230.

The first muffler 210 is coupled to a front end of the second muffler 230 and is press-fitted to the inner peripheral surface of the third muffler 250. The muffler filter 280 may be interposed at a boundary where the first and second mufflers 210 and 230 are coupled.

The second muffler 230 includes a body 231 that is configured such that a cross-sectional area of a flow passage of the refrigerant changes as it goes from the upstream to the downstream of the refrigerant flow based on a flow direction of the refrigerant. An inlet hole 232*a*, through which the refrigerant discharged from the inlet guide portion 156 is introduced, is formed at a rear end of the body 231 of the second muffler 230.

The body 231 of the second muffler 230 includes a first part 231*a* that extends from the inlet hole 232*a* toward the front to have a predetermined inner diameter, and a second part 231*b* that extends from the first part 231*a* to the front and has an inner diameter less than the inner diameter of the first part 231*a*. The inlet hole 232*a* of the second muffler 230 is formed at a rear end of the first part 231*a*.

According to the configuration described above, the refrigerant introduced into the second muffler 230 through the inlet hole 232*a* of the second muffler 230 passes through a flow passage that has a reduced cross-sectional area in a process of flowing from the first part 231*a* to the second part 231*b*.

A discharge hole 232*b* discharging the refrigerant passing through the second part 231*b* is formed at a front end of the body 231 of the second muffler 230. The discharge hole 232*b* of the second muffler 230 may be formed at a front end of the second part 231*b*.

The second muffler 230 includes a flange 233 that extends radially from an outer peripheral surface of a front portion of the body 231, and a flange extension 234 extending forward from the flange 233. The flange extension 234 may be press-fitted to the inner peripheral surface of the third muffler 250.

A boundary between the flange 233 and the flange extension 234 of the second muffler 230, i.e., a portion bent from the radial direction to the axial direction may form a "catching jaw" that allows the second muffler 230 to be caught in the stepped portion 254 of the third muffler 250.

A cross-sectional area of a flow passage formed inside the flange extension 234 may be formed to be greater than a cross-sectional area of a flow passage of the second part 231*b*. Thus, the refrigerant discharged from the body 231 of the second muffler 230 may be diffused while flowing into the flange extension 234. Since a flow rate of the refrigerant is reduced by the diffusion of the refrigerant, a noise reduction effect can be obtained.

For example, the second muffler 230 can reduce a noise of a high frequency band of 4 to 5 kHz. The refrigerant discharged from the second muffler 230 may pass through the muffler filter 280 and may be introduced into the first muffler 210.

The first muffler 210 includes a body 211 positioned in front of the muffler filter 280, i.e., positioned on the downstream side of the refrigerant flow. The body 211 of the first muffler 210 has a cylindrical shape with an empty interior and may extend forward. An inner space of the first muffler body 211 forms a refrigerant flow passage.

An inlet hole 211*a* into which the refrigerant passing through the muffler filter 280 is introduced is provided at the rear end of the body 211 of the first muffler 210. A discharge hole 211*b* through which the refrigerant passing through the body 211 is discharged is provided at the front end of the body 211 of the first muffler 210.

The first muffler 210 further includes a flange 212 that extends radially from an outer peripheral surface of the rear of the body 211. The flange 212 of the first muffler 210 may be coupled to the piston flange 132 of the piston 130.

A radially outer portion of the flange 212 of the first muffler 210 includes a piston coupling portion 212*a* coupled to a fastening groove (not shown) of the piston 130. The fastening groove (not shown) may be formed in the piston flange 132.

The third muffler 250 includes a piston coupling portion 251*a* coupled to the piston coupling portion 212*a*.

The piston coupling portion 251*a* of the third muffler 250 may be configured to extend outward radially from the front portion of the third muffler body 251.

The piston coupling portions 212*a* and 251*a* may be interposed between the supporter 137 and the piston flange 132. The piston coupling portion 251*a* may extend to be inclined outward in the radial direction with respect to the third muffler body 251. An angle θ between the body 251 of the third muffler 250 and the piston coupling portion 251*a* may be greater than 60° and less than 90°. The piston coupling portion 251*a* may be configured to be elastically deformable.

According to the above-described configuration, the piston coupling portions 212*a* and 251*a* can be stably supported between the supporter 137 and the piston flange 132. In the process of moving forward or rearward the intake muffler 200, the piston coupling portions 212*a* and 251*a* can move to be close to each other or spaced apart from each other by an inertial force. Hence, an excessive load can be prevented from being applied to the intake muffler 200.

The first muffler 210 includes a flange extension 213 extending rearward from the flange 212. The flange extension 213 may have a substantially cylindrical shape. The flange extension 213 may be press-fitted to the inner peripheral surface of the third muffler 250. The flange 212 of the first muffler 210 may include a flange connection portion 214 connected to the flange extension 213.

The flange extension 213 may support a front portion of the muffler filter 280. In other words, the muffler filter 280 may be interposed between the flange extension 213 of the first muffler 210 and the flange extension 234 of the second muffler 230.

The body 211 of the first muffler 210 may be configured such that a cross-sectional area of the flow passage of the refrigerant increases as it goes from the upstream to the downstream based on the flow direction of the refrigerant.

The body 211 of the first muffler 210 includes an intake guide portion 220 around the discharge hole 211*b* of the first muffler 210, and the intake guide portion 220 guides the refrigerant discharged from the discharge hole 211*b* to the intake port 133.

The intake guide portion 220 is configured to surround at least a part of the body 211 of the first muffler 210. The intake guide portion 220 includes a first extension 221 that extends outward radially from one point of the outer peripheral surface of the body 211 of the first muffler 210, and a second extension 223 that is spaced apart forward from the first extension 221.

The flange 212 of the first muffler 210 includes a flange communication hole 215. The communication hole 215 may be understood as configuration which guides a refrigerant pressure of an intake space 260 (see FIG. 8) to rapidly increase when the intake of the refrigerant into the compression chamber P is performed.

More specifically, when the refrigerant compressed in the compression chamber P is discharged to the discharge cover 160, the piston 130 moves from top dead center to bottom dead center, and the refrigerant suctioned by the compressor 10 in this process flows into the piston 130 through the intake muffler 200.

In this instance, as the refrigerant pressure in the intake space 260 is high and this state continues for a long time, the intake valve 135 opens faster and remains open for a long time, and thus a large amount of refrigerant may be introduced into the compression chamber P.

However, when a pressure in the intake space 260 is relatively low at a time at which the intake valve 135 is opened, an amount of refrigerant introduced into the compression chamber P through the opened intake valve 135 is reduced. Thus, it is necessary to rapidly increase the pressure in the intake space 260 according to the time at which the intake valve 135 is opened.

After the refrigerant is discharged from the compression chamber P, when the piston 130 moves rearward, that is, toward the bottom dead center, a phenomenon in which the refrigerant is not rapidly introduced into the first muffler 210 may occur by a volume of the refrigerant remaining between the piston 130 and the first muffler 210. Accordingly, the communication hole 215 may be understood as configuration which guides the remaining refrigerant to flow rearward and to be discharged from the piston 130.

The communication hole 215 may be formed to pass through at least a portion of the flange 212 of the first muffler 210. The plurality of communication holes 215 may be provided.

If the communication hole 215 is disposed to be biased at a specific position of the flange 212 of the first muffler 210, the refrigerant may not be easily discharged. Thus, the plurality of communication holes 215 allow the refrigerant to be evenly distributed in the up-down direction and the left-right direction based on the body 211 of the first muffler 210, and thus can allow the remaining refrigerant to be easily discharged rearward. Further, the number of flange communication holes 215 is not limited thereto.

The communication holes 215 may be formed between the flange connection portion 214 and the outer peripheral surface of the body 211 of the first muffler 210. Thus, the refrigerant discharged rearward through the communication holes 215 may flow into the flange extension 213 and may be introduced into the body 211 of the first muffler 210 through the inlet hole 211*a* of the first muffler 210, together with the refrigerant suctioned by the intake muffler 200.

In order to improve the pressure reduction at the inlet side of the intake muffler 200, the second muffler 230 includes a communication hole 235 communicating with the flange communication hole 215 of the first muffler 210 at its the flange 233.

The communication hole 235 may be formed to pass through at least a portion of the flange 233 of the second muffler 230. The plurality of communication holes 235 may be provided.

For example, when viewing the first muffler 210 from the front, the communication hole 235 of the second muffler 230 may be disposed to overlap the communication holes 215 of the first muffler 210.

Accordingly, the refrigerant discharged rearward through the communication holes 215 of the first muffler 210 may flow into the third muffler 250 through the communication holes 235 of the second muffler 230 and may be introduced into the body 211 of the first muffler 210 through the inlet hole 211*a* of the first muffler 210, together with the refrigerant suctioned by the intake muffler 200.

FIG. 12 is an experimental graph illustrating an improvement in a pressure reduction in a linear compressor adopting an intake muffler according to the first embodiment of the present disclosure, compared to a linear compressor according to the prior patent.

The refrigerant suctioned by the compressor 10 flows into the intake muffler 200 through the through hole 252 of the third muffler 250.

The refrigerant may pass through the second muffler 230 and may be introduced into the body 211 of the first muffler 210 through the inlet hole 211*a* of the first muffler 210.

The refrigerant in the body 211 of the first muffler 210 may flow into the intake space 260, and may be suctioned into the compression chamber P through the intake port 133 of the piston 130 when the intake valve 135 is opened. Here, the intake space 260 may be understood as a space between the body front portion 131*a* of the piston 130 and the front end of the intake muffler 200, i.e., the front end of the first muffler 210.

When a pressure of the compression chamber P is higher than a pressure of the intake space 260, the intake valve 135 is closed, and a volume of the compression chamber P decreases while the piston 130 moves forward. Hence, the compression of the refrigerant is achieved.

When the pressure of the compression chamber P increases and is higher than a pressure of the discharge space 160*a*, the discharge of the refrigerant is achieved while the discharge valve 161 is opened.

When the discharge of the refrigerant is achieved, the piston 130 and the intake muffler 200 move to the rear, and the refrigerant is suctioned into the intake muffler 200 as described above.

In this instance, since the refrigerant remaining in the piston 130, i.e., the space between the piston 130 and the first muffler 210 or the intake space 260 is discharged to the rear through the communication holes 215 of the first muffler 210 and the communication holes 235 of the second muffler 230, the refrigerant can be rapidly suctioned into the intake muffler 200.

Accordingly, the decompression of the refrigerant in the intake space 260 can decrease.

A discharge space 211*e* having a flow passage, through which the remaining refrigerant is discharged, is formed between the inner peripheral surface of the piston body 131 and the outer peripheral surface of the body 211 of the first muffler 210. The refrigerant flows from the intake space 260 to the rear through the discharge space 211*e* and is discharged to the inner space of the third muffler 250 through the communication holes 215 of the first muffler 210 and the communication holes 235 of the second muffler 230.

As above, in the process in which the piston 130 moves from top dead center to bottom dead center, a circulation of the refrigerant flow may occur while the discharge and the intake of the refrigerant in the piston 130 are fulfilled together.

FIG. 12 illustrates pressures measured at several points in the intake muffler according to the first embodiment of the present disclosure and the intake muffler according to the prior art.

As illustrated in FIG. 12, in the prior art, a difference between a pressure measured at the inlet guide portion 156 and a pressure measured inside the second muffler 230 is approximately 7,000 Pa. On the other hand, in the first embodiment of the present disclosure, a difference between a pressure measured at the inlet guide portion 156 and a pressure measured inside the second muffler 230 is approximately 5,000 Pa.

Accordingly, a pressure reduction at an inlet side of the intake muffler 200 in the first embodiment can be more efficiently improved compared to the prior art.

In addition, in the first embodiment, due to an improvement in the pressure reduction at the inlet side of the intake muffler 200, a pressure at an outlet side of the intake muffler 200 can also be improved compared to the prior art.

Referring to FIG. 12, in the prior art, a difference between a pressure measured at the inlet guide portion and a pressure measured at an inlet of the intake port is approximately 9,000 Pa. On the other hand, in the first embodiment, a difference between a pressure measured at the inlet guide portion 156 and a pressure measured at an inlet of the intake port is approximately 7,000 Pa.

With reference to FIGS. 13 to 19, an intake muffler according to other embodiments of the present disclosure is described below.

In describing the following embodiments, the same reference numerals are given to the same components as those of the intake muffler according to the first embodiment described above, and a detailed description thereof will be omitted.

Figure 13:
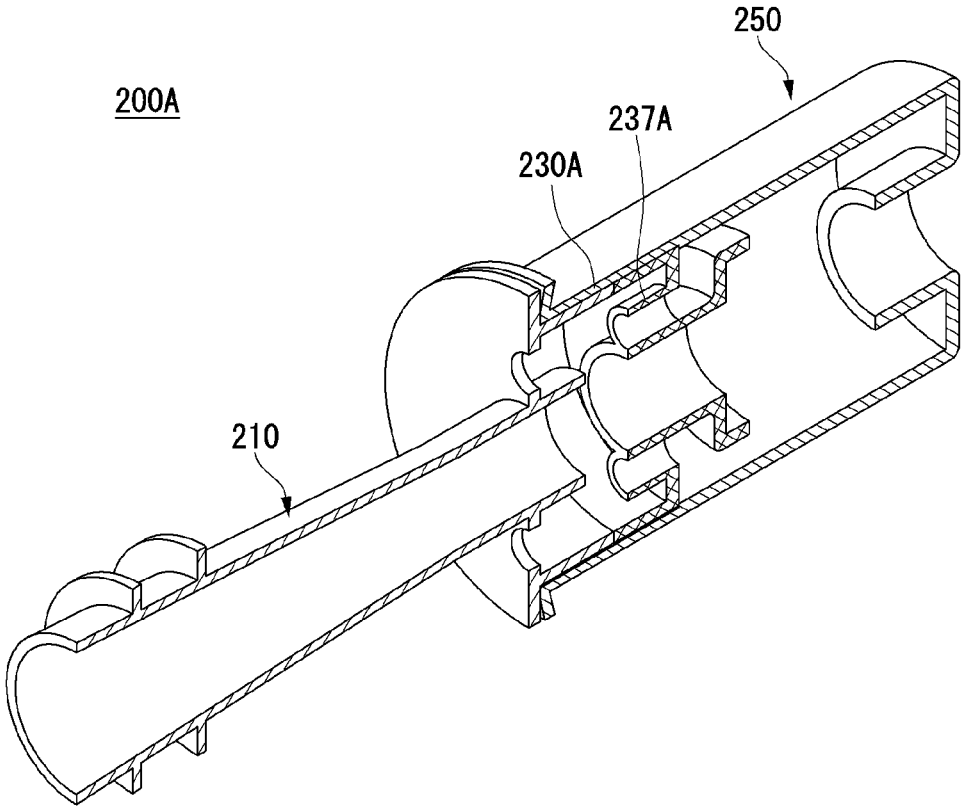
FIG. 13 is a cross-sectional perspective view of an intake muffler according to a second embodiment of the present disclosure.
Figure 14:
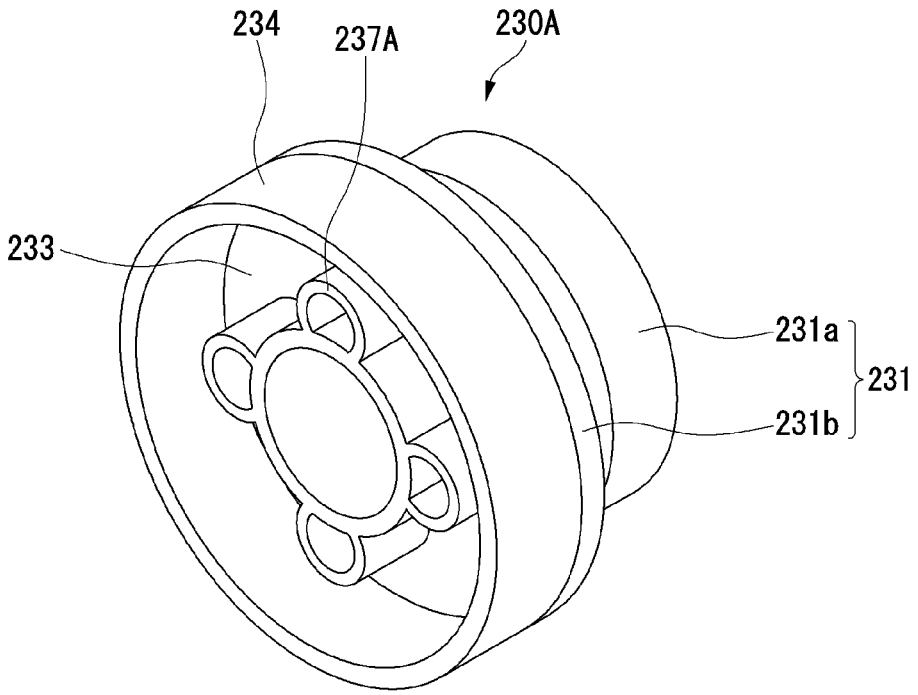
FIG. 14 is a perspective view of a second muffler included in an intake muffler according to a second embodiment of the present disclosure.

FIG. 13 is a cross-sectional perspective view of an intake muffler according to a second embodiment of the present disclosure. FIG. 14 is a perspective view of a second muffler included in the intake muffler according to the second embodiment of the present disclosure.

As illustrated in FIGS. 13 and 14, the intake muffler according to the second embodiment has basically the same structure as the intake muffler according to the first embodiment described above, and they have a difference only in a structure of a second muffler.

More specifically, a second muffler 230A of an intake muffler 200A according to the second embodiment further includes a communication pipe 237A connected to a communication hole 235. The communication pipe 237A extends from a flange 233 in the same direction as a flange extension 234 and is formed to be shorter than the flange extension 234.

For example, an end of the communication pipe 237A may extend to an end of a second part 231*b*. That is, the end of the communication pipe 237A and the end of the second part 231*b* may coincide with each other in the axial direction.

The second embodiment describes that each of the communication pipe 237A and the communication hole 235 is provided in the same number as the number of communication holes 215 of a first muffler 210, by way of example. However, the number of communication pipes 237A and the number of communication holes 235 may be less than the number of communication holes 215.

For example, one or two communication pipes 237A and one or two communication holes 235 may be provided.

In addition, the number of communication pipes 237A may be the same as or may be less than the number of communication holes 235.

Figure 15:
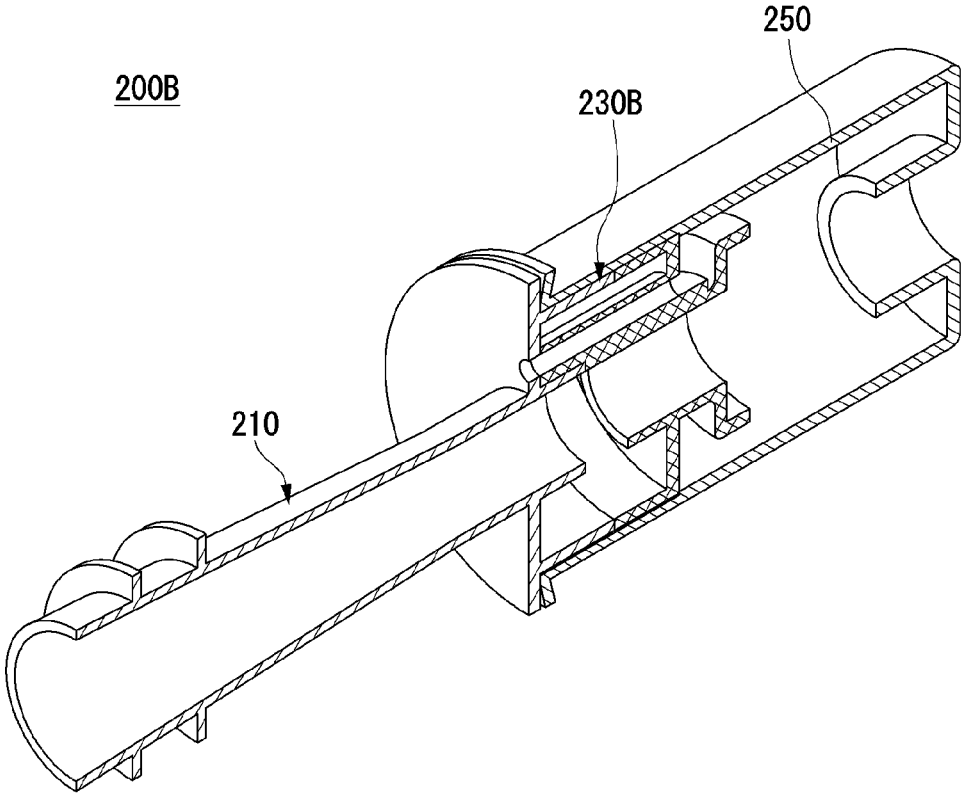
FIG. 15 is a cross-sectional perspective view of an intake muffler according to a third embodiment of the present disclosure.
Figure 16:
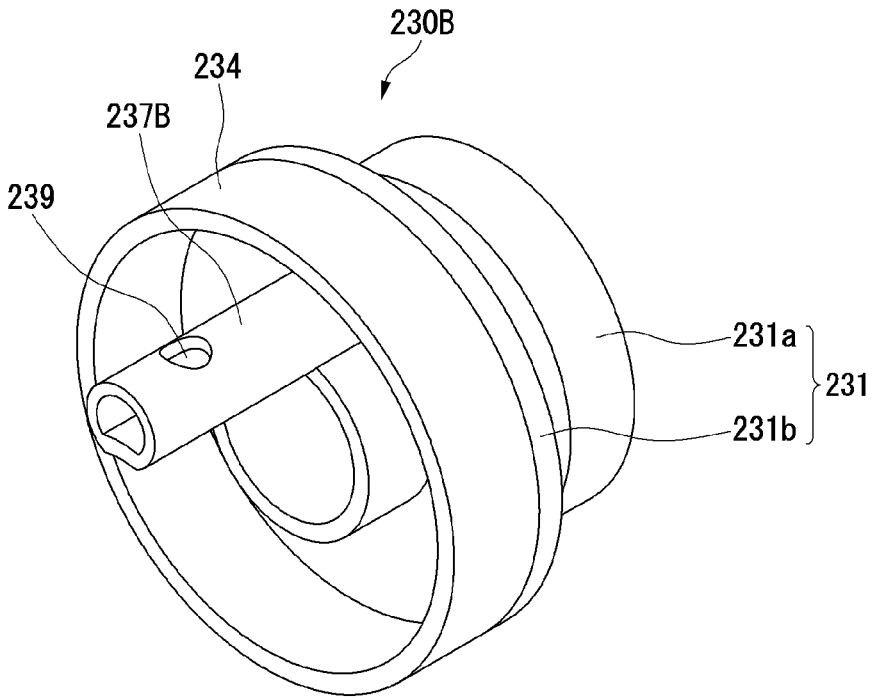
FIG. 16 is a perspective view of a second muffler included in an intake muffler according to a third embodiment of the present disclosure.

Unlike this, as illustrated in FIGS. 15 and 16, in a second muffler 230B, a length of a communication pipe 237B connected to a communication hole 235 may be greater than a length of a flange extension 234.

For example, the communication pipe 237B may be formed to have a length sufficient to contact a flange 212 of a first muffler 210.

According to this, since a refrigerant flowing into a communication hole 215 of the first muffler 210 flows through the communication pipe 237B and the communication hole 235, the refrigerant of a discharge space 211*e* does not flow into a space formed by a rear end of the first muffler 210 and a front end of the second muffler 230B and may flow into an inner space of a third muffler 250.

This embodiment describes that the number of each of the communication hole 215, the communication hole 235, and the communication pipe 237B is one, by way of example. However, each may be in plural in the same manner as the first and second embodiments described above.

In addition, the number of communication pipes 237B may be the same as or may be less than the number of communication holes 235.

In an intake muffler 200B according to this embodiment, another communication hole 239 may be further provided in the communication pipe 237B.

In this case, the refrigerant remaining in the space formed by the rear end of the first muffler 210 and the front end of the second muffler 230B may flow into the third muffler 250 through the communication hole 239.

Figure 17:
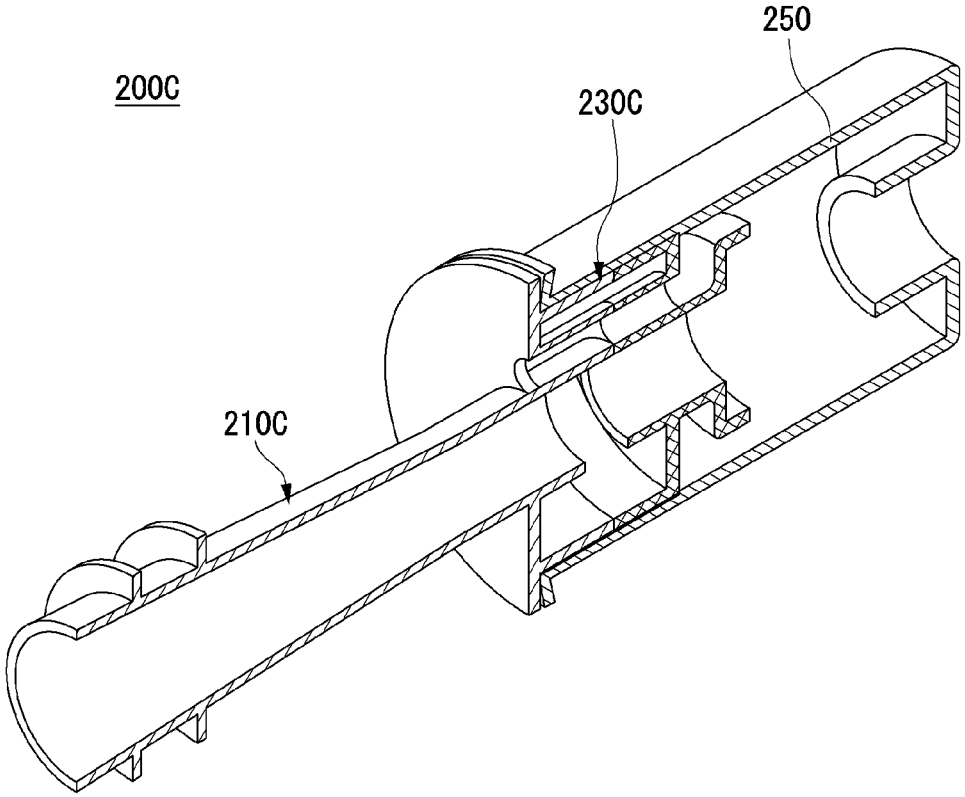
FIG. 17 is a cross-sectional perspective view of an intake muffler according to a fourth embodiment of the present disclosure.
Figure 18:
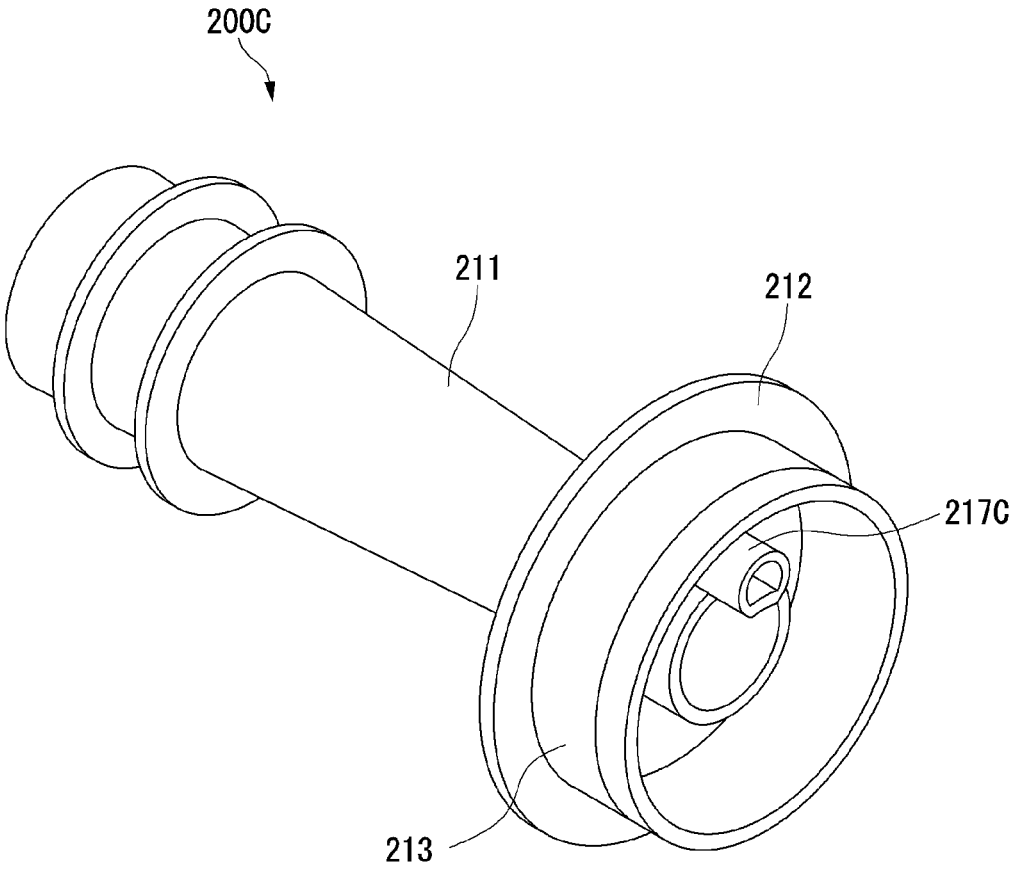
FIG. 18 is a perspective view of a first muffler included in an intake muffler according to a fourth embodiment of the present disclosure.
Figure 19:
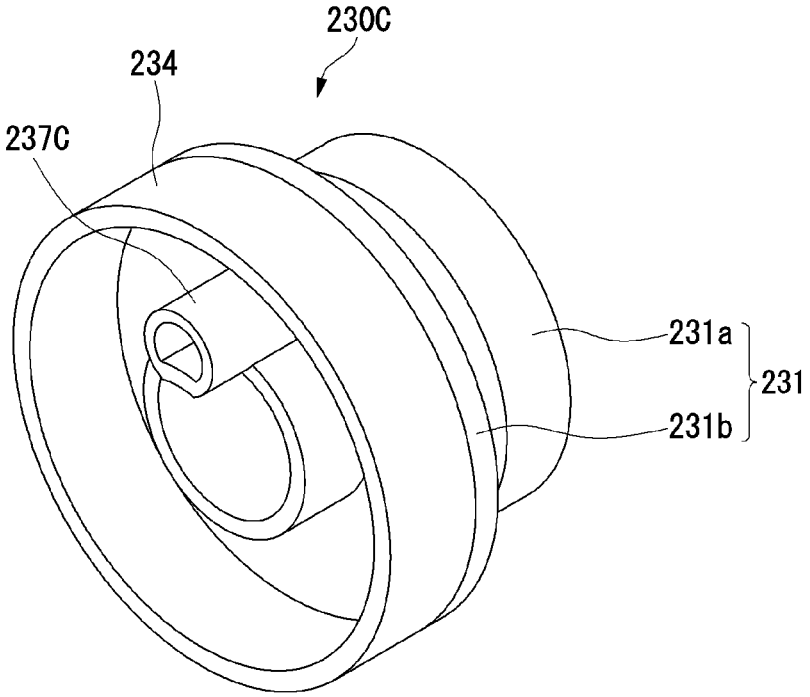
FIG. 19 is a perspective view of a second muffler included in an intake muffler according to a fourth embodiment of the present disclosure.

Unlike this, as illustrated in FIGS. 17 to 19, a first muffler 210C may include a communication pipe 217C connected to a communication hole 215, and a second muffler 230C may include a communication pipe 237C connected to a communication hole 235.

The communication pipe 217C protrudes rearward toward the second muffler 230C, and the communication pipe 237C protrudes forward toward the first muffler 210C.

One end of the communication pipe 217C contacts one end of the communication pipe 237C. However, one end of the communication pipe 217C may be spaced apart from one end of the communication pipe 237C.

According to this, since a refrigerant flowing into the communication hole 215 of the first muffler 210C flows through the communication pipe 217C, the communication pipe 237C, and the communication hole 235, the refrigerant of a discharge space 211*e* does not flow into a space formed by a rear end of the first muffler 210C and a front end of the second muffler 230C and may flow into an inner space of a third muffler 250.

This embodiment describes that the number of each of the communication hole 215, the communication pipe 217C, the communication hole 235, and the communication pipe 237C is one, by way of example. However, each may be in plural in the same manner as the first and second embodiments described above.

In an intake muffler 200C according to this embodiment, a communication hole may be further provided in at least one of the communication pipe 217C and the communication pipe 237C, as in the third embodiment.

In this case, the refrigerant remaining in the space formed by the rear end of the first muffler 210C and the front end of the second muffler 230C may flow into the third muffler 250 through the communication hole.

What is claimed is:

1. A linear compressor comprising:

a shell;

an intake pipe disposed at the shell and configured to supply a refrigerant into the shell;

a cylinder disposed inside the shell;

a piston disposed inside the cylinder and configured to reciprocate relative to the cylinder, the piston comprising a piston body and a piston flange; and an intake muffler coupled to the piston and configured to carry the refrigerant supplied through the intake pipe into the piston body to thereby reduce a flow noise of the refrigerant, wherein the intake muffler comprises:

a first muffler disposed inside the piston body, the first muffler comprising (i) a first muffler body that defines a first refrigerant flow passage extending in an axial direction and (ii) a first muffler flange that extends radially outward from the first muffler body and defines a first communication portion, a second muffler that is disposed rearward relative to the first muffler in a direction away from the piston body and in fluid communication with the first muffler, the second muffler comprising (i) a second muffler body that defines a second refrigerant flow passage extending in the axial direction and (ii) a second muffler flange that extends radially outward from the second muffler body and defines a second communication portion, and a third muffler that extends toward the piston body and accommodates the second muffler and a portion of a rear end of the first muffler, wherein the second communication portion of the second muffler is defined at the second muffler flange outside the second muffler body and in fluid communication with the first communication portion of the first muffler through a space between the first muffler and the second muffler, wherein a discharge space is defined between the piston body and the first muffler body, and wherein the third muffler defines an inner space that is configured to receive the refrigerant from the discharge space through the first and second communication portions based on the piston moving rearward from a first position facing a front end of the cylinder toward a second position disposed rearward relative to the first position.

2. The linear compressor of claim 1, wherein the discharge space is defined between an inner surface of the piston body and an outer surface of the first muffler body and configured to guide the refrigerant in the piston body to the first communication portion.

3. The linear compressor of claim 2, wherein the first communication portion comprises a first communication hole, and the second communication portion comprises a second communication hole.

4. The linear compressor of claim 3, wherein the second muffler further comprises a communication pipe that is in fluid communication with the second communication hole.

5. The linear compressor of claim 4, wherein the communication pipe extends forward relative to the second communication hole toward the first communication hole.

6. The linear compressor of claim 5, wherein the second muffler body comprises:

a first part that defines an inlet hole of the second muffler and extends forward relative to the inlet hole, the first part having a first inner diameter; and a second part that extends forward relative to the first part, the second part having a second inner diameter less than the first inner diameter, and wherein the second muffler flange and the communication pipe are disposed at an outer peripheral surface of the second part.

7. The linear compressor of claim 6, wherein the communication pipe extends along the axial direction, and an end of the communication pipe is flush with an end of the second part in the axial direction.

8. The linear compressor of claim 6, wherein the communication pipe extends along the axial direction, an end of the communication pipe contacts the first muffler flange.

9. The linear compressor of claim 8, wherein the communication pipe defines a pipe communication hole configured to supply the refrigerant in a space between the rear end of the first muffler and a front end of the second muffler into the third muffler.

10. The linear compressor of claim 3, wherein the first muffler further comprises a first communication pipe that is in fluid communication with the first communication hole, and wherein the second muffler further comprises a second communication pipe that is in fluid communication with the second communication hole.

11. The linear compressor of claim 10, wherein the first communication pipe protrudes rearward toward the second communication hole.

12. The linear compressor of claim 11, wherein the first communication pipe and the second communication pipe are in contact with each other and in fluid communication with each other.

13. The linear compressor of claim 12, wherein at least one of the first communication pipe or the second communication pipe defines a pipe communication hole configured to supply the refrigerant in a space between the rear end of the first muffler and a front end of the second muffler into the third muffler.

14. The linear compressor of claim 1, wherein the first communication portion is one of a plurality of first communication portions that are arranged at the first muffler flange.

15. The linear compressor of claim 14, wherein the second communication portion is one of a plurality of second communication portions that are arranged at the second muffler flange.

16. The linear compressor of claim 14, wherein each of the first muffler and the second muffler is press-fitted into and coupled to an inner peripheral surface of the third muffler.

17. The linear compressor of claim 14, further comprising:

a muffler filter positioned at a boundary between the first muffler and the second muffler.

18. The linear compressor of claim 17, wherein the first muffler flange and the second muffler flange face each other and define the boundary, and wherein the muffler filter is in contact with the first muffler flange and the second muffler flange.

19. The linear compressor of claim 14, wherein a cross-sectional area of the first refrigerant flow passage in the first muffler body increases from an upstream side to a downstream side along a flow direction of the refrigerant.

20. The linear compressor of claim 19, wherein the upstream side of the first muffler body is disposed outside the piston body and faces the second muffler, and wherein the downstream side of the first muffler is disposed in the piston body and located away from the second muffler.

* * * * *